US005164531A

United States Patent [19]

Imaizumi et al.

[11] Patent Number: 5,164,531

[45] Date of Patent: Nov. 17, 1992

[54] AUTOMATIC ACCOMPANIMENT DEVICE

[75] Inventors: Tsutomu Imaizumi; Minoru Kitamura, both of Hamamatsu, Japan

[73] Assignee: Yamaha Corporation, Hamamatsu, Japan

[21] Appl. No.: 820,530

[22] Filed: Jan. 14, 1992

[30] Foreign Application Priority Data

Jan. 16, 1991 [JP] Japan ..... 3-017039

[51] Int. Cl.[5] ..... G10H 1/36; G10H 7/00

[52] U.S. Cl. ..... 84/634; 84/DIG. 12; 84/DIG. 22

[58] Field of Search ..... 84/609-614, 84/634-638, DIG. 12, DIG. 22

[56] References Cited

U.S. PATENT DOCUMENTS

| | | | |
|---|---|---|---|
| 4,326,441 | 4/1982 | Imamura et al. | 84/DIG. 12 |
| 4,628,788 | 12/1986 | Shibukawa | 84/DIG. 12 |
| 4,889,026 | 12/1989 | Abe | 84/611 |
| 4,926,737 | 5/1990 | Minamitaka | 84/611 |
| 4,936,183 | 6/1990 | Rauchi . | |
| 5,052,267 | 10/1991 | Ino | 84/613 |

FOREIGN PATENT DOCUMENTS

| | | |
|---|---|---|
| 63-1598 | 1/1988 | Japan . |
| 2-178697 | 11/1990 | Japan . |

*Primary Examiner*—Stanley J. Witkowski
*Attorney, Agent, or Firm*—Graham & James

[57] ABSTRACT

Plural normal pattern data, plural introduction pattern data, plural fill-in pattern data and plural ending pattern data for each of various accompaniment styles such as march, waltz and rock are stored in a memory. Relation of correspondence among these pattern data is predetermined and, at transfer from one pattern to another such as transfer from a certain introduction pattern to a normal pattern, transfer from a certain normal pattern to a fill-in pattern, transfer back from the fill-in pattern to the normal pattern or transfer from a certain normal pattern to an ending pattern, predetermined pattern data which corresponds to a pattern which has been so far performed is automatically determined and transfer to the determined pattern is automatically made. Transfer of the pattern which is automatically determined can also be changed as desired by selection by the player.

9 Claims, 18 Drawing Sheets

SCTTBL(STLN,SCTN)

| TRKN | BAR | VOL |
|---|---|---|
| 0 CHORD 1 | 2 | 0 |
| . . . | . . . | . . . |
| 5 CHORD 6 | 1 | 0 |
| 6 BASS | 4 | 2 |
| 7 RHYT. 1 | 1 | 0 |
| 8 RHYT. 2 | 2 | 0 |

AUTOMATIC ACCOMPANIMENT DEVICE

BACKGROUND OF THE INVENTION

This invention relates to an automatic accompaniment device for automatically producing accompaniment tones such as chord constituting tones, bass tones and percussion instrument tones.

As disclosed in Japanese Patent Publication No. Sho-63-1598 and Japanese Laid-open Patent Publication No. Hei-2-178697, prior art automatic accompaniment devices have an accompaniment pattern memory which stores accompaniment pattern data including normal pattern data, introduction pattern data and fill-in pattern data for each of accompaniment styles such as march, walz and rock to impart an automatic accompaniment by introduction pattern data before starting of automatic accompaniment by normal pattern data and also insert automatic accompaniment by fill-in pattern data during automatic accompaniment by normal pattern data and thereby to eliminate monotonousness in the automatic accompaniment.

In the prior art automatic accompaniment devices, however, only one pattern data for respective types of data, i.e., normal, introduction and fill-in pattern data, is prepared for each accompaniment style and, therefore, an automatic accompaniment tone which is most suited to the spirit or mood of music piece performed can not necessarily be produced.

U.S. Pat. No. 4,936,183 discloses an automatic accompaniment system in which two different break patterns can be selectively filled in. When a first break pattern selection switch has been depressed, an accompaniment performance according to a predetermined first break pattern is filled in and thereafter the performance is changed to a predetermined first normal accompaniment pattern (chorus pattern). When a second break pattern selection switch has been depressed, an accompaniment performance according to a predetermined second break pattern is filled in and thereafter the performance is changed to a predetermined second normal accompaniment pattern (verse pattern). In this case, there are provided two types of break patterns and normal patterns for one accompaniment style. Since, however, the break pattern and the following normal pattern are determined without any variation by operation of the break pattern switch, there arises the inconvenience that an accompaniment performance which does not match progress of the music before filling in of the break pattern may be brought about.

SUMMARY OF THE INVENTION

It is, therefore, an object of the invention to provide an automatic accompaniment device which stores plural pattern data for respective pattern data such as normal, introduction and fill-in pattern data for each of accompaniment styles thereby to enable generation of an automatic accompaniment tone most suited to the spirit or mood of music piece performed and which is also capable of switching between respective patterns such as normal, introduction, fill-in and ending patterns by a simple operation and in a manner which is musically natural and sufficiently reflecting the will of a player of the automatic accompaniment device.

For achieving the above object of the invention, an automatic accompaniment device according to one aspect of the invention comprises data memory means storing plural introduction pattern data and plural normal pattern data for each of plural accompaniment styles, each of said plural introduction pattern data corresponding to specific one of said plural normal pattern data, accompaniment style designation means for designating one of said plural accompaniment styles, introducing pattern designation means for designating one of said plural introduction pattern data, introduction readout control means for reading from said data memory means the introduction pattern data designated by said introduction pattern designation means among the plural introduction pattern data of the accompaniment style designated by said accompaniment style designation means, normal readout control means for reading, after reading of the introduction pattern data by said introduction readout control means, the normal pattern data corresponding to the read out introduction pattern data from said data memory means, and accompaniment tone signal generation means for generating an accompaniment tone signal in accordance with the introduction pattern data and normal pattern data read out by said readout control means.

According to the above automatic accompaniment device, each of the plural introduction pattern data corresponds to specific one of the plural normal pattern data and, after performance of automatic accompaniment according to the designated introduction pattern, the automatic accompaniment is transferred automatically to one according to a normal pattern which is proper to this introduction pattern. Referring, for facilitating understanding, to FIG. 1 which schematically shows a manner of switching of the automatic accompaniment pattern according to an embodiment of the invention, normal patterns NOR1–NOR3 correspond respectively to introduction patterns INT1–INT3. Thus, plural introduction pattern data and plural normal pattern data for each of plural accompaniment styles are stored so that a desired one can be selected from among plural introduction patterns corresponding to one accompaniment style and a proper normal pattern corresponding to the selected introduction pattern can be automatically selected from among plural normal patterns. Accordingly, performance of introduction patterns and normal patterns which are suited to the spirit or mood of various music pieces performed can be realized. Moreover, transfer from the introduction pattern performance to the normal pattern performance can be automatically performed in a manner which is musically natural without requiring a particular operation by the player.

The automatic accompaniment device may further comprise normal pattern designation means for designating one of said plural normal pattern data, and change means, responsive to designation of the normal pattern data has been made by said normal pattern designation means during reading of the introduction pattern data by said introduction readout control means, for changing normal pattern data which is to be read from said data memory means by said normal readout control means to the normal pattern data which has been designated by said normal pattern designation means. By this arrangement, the player can designate a normal pattern which is to be transferred from an introduction pattern as desired whereby performance of introduction and normal patterns can be made in a manner in which the player's will is reflected.

For achieving the above described object of the invention, an automatic accompaniment device according to another aspect of the invention comprises data memory means storing plural normal pattern data and plural fill-in pattern data for each of plural accompaniment styles, each of said plural normal pattern data corresponding to specific one of said plural fill-in pattern data, accompaniment style designation means for designating one of said plural accompaniment styles, normal pattern designation means for designating one of said plural normal pattern data, fill-in instruction means for instructing execution of a fill-in performance, normal readout control means for reading from said data memory means the normal pattern data designated by said normal pattern designation means among the plural normal pattern data of the accompaniment style designated by said accompaniment style designation means, fill-in readout control means, responsive to instruction of the fill-in performance by said fill-in instruction means during reading of the normal pattern data by said normal readout control means, for reading the fill-in pattern data corresponding to the normal pattern data which as been read out by said normal readout control means from said data memory means instead of reading of the normal pattern data, normal pattern restoration means for redesignating, upon completion of reading of the fill-in pattern data by said fill-in readout control means, the normal pattern data which was previously read out and controlling said normal readout control means to read out the redesignated normal pattern data from said data memory means, and accompaniment tone signal generation means for generating an accompaniment tone signal in accordance with the normal pattern data and fill-in pattern data which have been read by said readout control means.

According to this automatic accompaniment device, each of normal pattern data corresponds to specific one of the plural fill-in pattern data and, in response to instruction of the fill-in performance during an automatic performance according to a certain normal pattern, a proper fill-in pattern which corresponds to the normal pattern is automatically selected and the automatic accompaniment is transferred to one according to the fill-in pattern. Upon completion of the fill-in, normal pattern data which was previously read out is designated again and the automatic performance is restored to performance according to the designated normal pattern. In the example of FIG. 1, the mode corresponding to this is one in which the automatic accompaniment is transferred from respective normal patterns NOR1–NOR4 to their proper fill-in patterns FIL1 and then is restored to the original normal patterns NOR-1–NOR4. Thus, plural normal pattern data and plural fill-in pattern data for each of plural accompaniment styles are stored and, accordingly, a desired one corresponding to the designated accompaniment style can be selected from among plural normal pattern data and, when fill-in is executed, a proper fill-in pattern corresponding to the selected normal pattern can be automatically selected from among plural fill-in patterns,. Performance of normal patterns and fill-in patterns suited to the spirit or mood of music pieces performed can be realized. Moreover, transfer from a normal pattern performance to a musically natural fill-in performance and a transfer from a fill-in performance to a musically natural normal performance can be realized without requiring a particular operation by the player.

The automatic accompaniment device may further comprise designation change means, responsive to designation of normal pattern data by said normal pattern designation means during reading of the fill-in pattern data by said fill-in readout control means, for controlling said normal pattern restoration means to designate the normal pattern data which has been designated by said normal pattern designation means instead of the normal pattern data which was previously read out. By this arrangement, the pattern of a normal performance to which the automatic performance is to be transferred from a fill-in performance can be designated by the player as desired whereby a normal pattern performance and a fill-in performance in which the will of the player is reflected can be realized.

For achieving the above described object of the invention, an automatic accompaniment device according to another aspect of the invention comprises data memory means storing plural normal pattern data and plural fill-in pattern data for each of plural accompaniment styles, each of said plural normal pattern data corresponding to specific one of said plural fill-in pattern data, accompaniment style designation means for designating one of said plural accompaniment styles, normal pattern designation means for designating one of said plural normal pattern data, fill-in instruction means for instructing execution of a fill-in performance, normal readout control means for reading from said data memory means the normal pattern data designated by said normal pattern designation means among the plural normal pattern data of the accompaniment style designated by said accompaniment style designation means, fill-in readout control means, responsive to instruction of the fill-in performance by said fill-in instruction means during reading of the normal pattern data by said normal readout control means, for reading the fill-in pattern data corresponding to the normal pattern data which has been read out by said normal readout control means from said data memory means instead of reading of the normal pattern data, normal pattern restoration means for designating, upon completion of reading of the fill-in pattern data by said fill-in readout control means, second normal pattern data which is different from the normal pattern data which was previously read out and controlling said normal readout control means to read out the designated second normal pattern data from said data memory means, and accompaniment tone signal generation means for generating an accompaniment tone signal in accordance with the normal pattern data and fill-in pattern data when have been read by said readout control means.

According to this automatic accompaniment device, in response to instruction of the fill-in performance during an automatic accompaniment performance according to a certain normal pattern, a proper normal pattern corresponding to this normal pattern is automatically selected and the automatic accompaniment is transferred to one according to the fill-in pattern. Upon completion of the fill-in, second normal pattern data which is different from the previously read out normal pattern data is designated and performance according to the designated second normal pattern is restored. In the example of FIG. 1, the mode corresponding to this is one in which the automatic accompaniment is transferred from respective normal patterns NOR1–NO4 to their proper fill-in patterns FIL2 and then is restored to a normal pattern (one of NOR1–NOR4) which is different from the original normal pattern. Since the automatic accompaniment is restored not to the original normal pattern performance but to a normal pattern performance which is different from the original normal pattern when a normal pattern is restored after fill-in, transfer from normal pattern performance to fill-in pattern performance and transfer from fill-in performance to normal pattern performance which are rich in variety and match the flow of a music piece performed can be realized.

For achieving the above described object of the invention, an automatic accompaniment device according to another aspect of the invention comprises data memory means storing plural normal pattern data and plural fill-in pattern data for each of plural accompaniment styles, first one of said plural normal pattern data corresponding to first one of said plural fill-in pattern data, second one of said plural normal pattern data corresponding to second one of said plural fill-in pattern data, accompaniment style designation means for designating one of said plural accompaniment styles, normal pattern designation means for designating one of said plural normal pattern data, fill-in instruction means having a switch for instructing execution of a fill-in performance, normal readout control means for reading from said data memory means the normal pattern data designated by said normal pattern designation means among the plural normal pattern data of the accompaniment style designated by said accompaniment style designation means, fill-in readout control means for reading, in response to instruction of the fill-in performance by said fill-in readout control means for reading, in response to instruction of the fill-in performance by said fill-in instruction means during reading of the first normal pattern data by said normal readout control means, the first fill-in pattern data from said data memory means instead of reading of the first normal pattern data by said normal readout control means and, also for reading, in response to instruction of the fill-in performance by said fill-in instruction means during reading of the second normal pattern data by said normal readout control means, the second fill-in pattern data from said data memory means instead of reading the second normal pattern data by said normal readout control means, normal pattern restoration means for designating, upon completion of reading of the fill-in pattern data by said fill-in readout control means, the second normal pattern data if the fill-in pattern data which has been read out is the first fill-in pattern data and controlling said normal readout control means to read out the designated second normal pattern data from said data memory means and designating the first normal pattern data if the fill-in pattern data which has been read out is the second fill-in pattern data and controlling said normal readout control means to read out the designated first normal pattern data from said data memory means, and accompaniment tone signal generation means for generating an accompaniment tone signal in accordance with the normal pattern data and fill-in pattern data which have been read by said readout control means.

According to this automatic accompaniment device, the first normal pattern and the second normal pattern constitute a pair and, in transfer from a normal pattern to a fill-in pattern, a proper fill-in pattern corresponding to the normal pattern is automatically selected (from the first normal pattern to the first fill-in pattern and from the second normal pattern to the second fill-in pattern) and, in transfer from a fill-in pattern to a normal pattern, the other normal pattern of the pair is automatically selected (from the first fill-in pattern to the second normal pattern and from the second fill-in pattern to the first normal pattern). In the example of FIG. 1, the normal patterns NOR1 and NOR2, for example, constitute a pair and transfer is made from NOR1 to its proper FIL2 corresponding thereto and then to NOR3. On the other hand, transfer is made from NOR3 to its proper FIL2 corresponding thereto and then to NOR1. Thus, the fill-in pattern is different between when transfer is made from the first normal pattern to the second normal pattern through a fill-in pattern and when transfer is made conversely from the second normal pattern to the first normal pattern through a fill-in pattern and, accordingly, normal pattern and fill-in pattern performances which are suited to the spirit or mood of various music pieces and match the flow of a music piece performed can be realized and, moreover, transfer from normal pattern performance to fill-in pattern performance and transfer from fill-in pattern performance to normal pattern performance which are rich in variety can be realized.

For achieving the above described object of the invention, an automatic accompaniment device according to still another aspect of the invention comprises data memory means storing plural normal pattern data and plural ending pattern data for each of plural accompaniment styles, each of said plural normal pattern data corresponding to specific one of said plural ending pattern data, accompaniment style designation means for designating one of said plural accompaniment styles, normal pattern designation means for designating one of said plural normal pattern data, ending instruction means for instructing execution of an ending performance, normal readout control means for reading from said data memory means the normal pattern data designated by said normal pattern designation means among the plural normal pattern data of the accompaniment style designated by said accompaniment style designation means, ending readout control means, responsive to instruction of the ending performance by said ending instruction means during reading of the normal pattern data by said normal readout control means, for stopping reading of the normal pattern data by said normal readout control means and, for reading from said data memory means the ending pattern data corresponding to the normal pattern data which has been read out, and accompaniment tone signal generation means for generating an accompaniment tone signal in accordance with the normal pattern data and ending pattern data which have been read by said readout control means.

According to this automatic accompaniment device, each of the plural normal pattern data corresponds to specific one of the plural ending pattern data. In response to instruction of ending performance during an automatic performance according to a certain normal pattern, an ending pattern corresponding to this normal pattern is automatically selected and the accompaniment pattern is transferred to one according to the ending pattern whereby the automatic performance comes to an end. In the example of FIG. 1, the mode of transfer from the respective normal patterns NOR1–NOR4 to corresponding ending patterns END1–END3 corresponds to this. Accordingly, normal pattern and ending pattern performances which are suited to the spirit and mood of various music pieces performed can be realized and, besides, transfer from a normal pattern performance to an ending pattern performance which is musically natural can be realized without requiring a particular operation by the player.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 2:
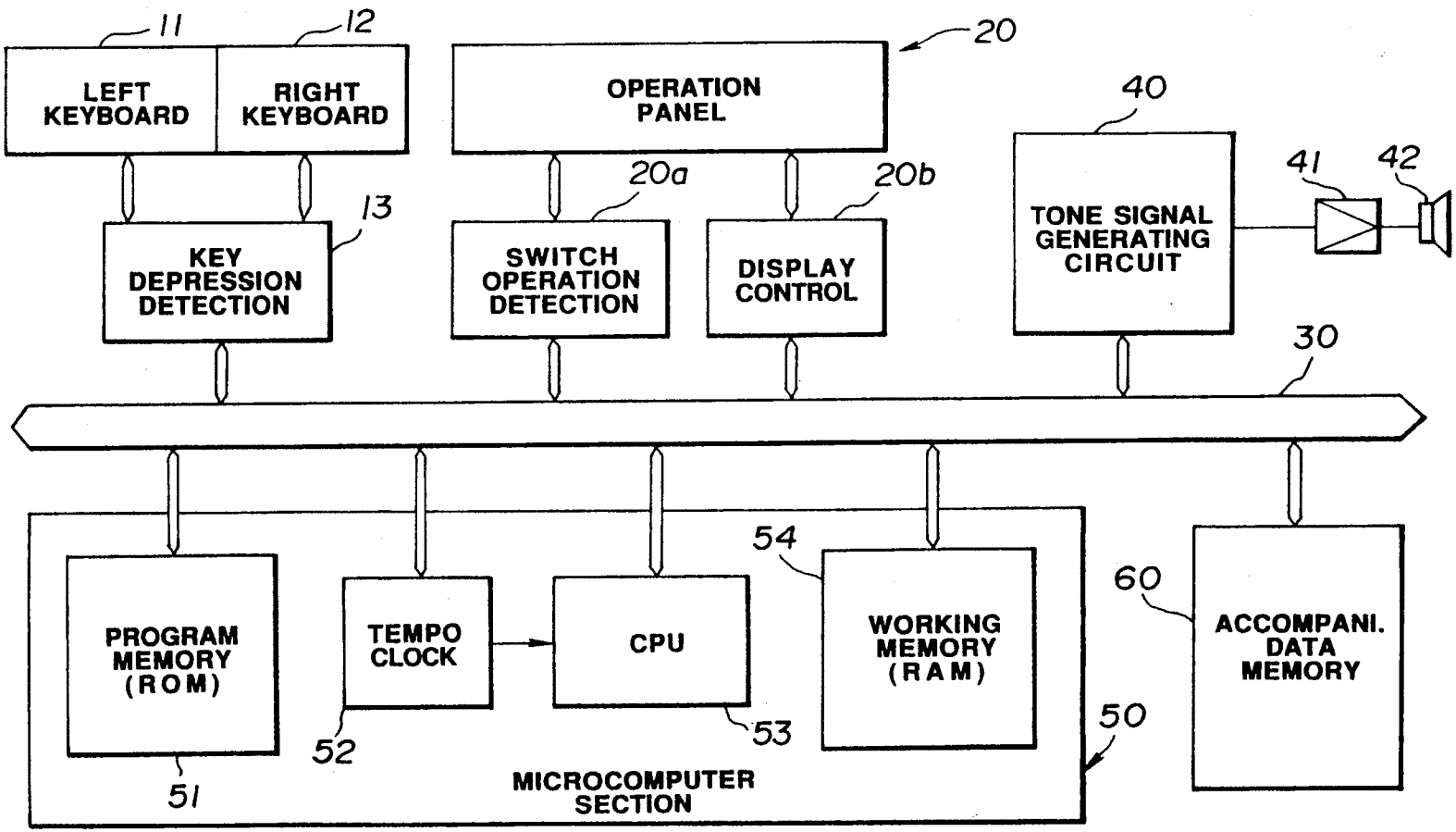
FIG. 2 is a block diagram showing the entire construction of an electronic musical instrument having an automatic accompaniment device according to one embodiment of the invention.

FIG. 2 is a block diagram showing the entire construction of an electronic musical instrument having an automatic accompaniment device according to the invention. In the figure, the electronic musical instrument has a left keyboard 11, a right keyboard 12 and an operation panel 20. The left keyboard 11 has a plurality of keys and is used for performing a chord. The right keyboard 12 has also a plurality of keys and is used for performing a melody. Keys which have been depressed in these keyboards are detected by opening and closing of key switches of a key depression detection circuit 13 provided in correspondence to the respective keys of these keyboards.

Figure 3:
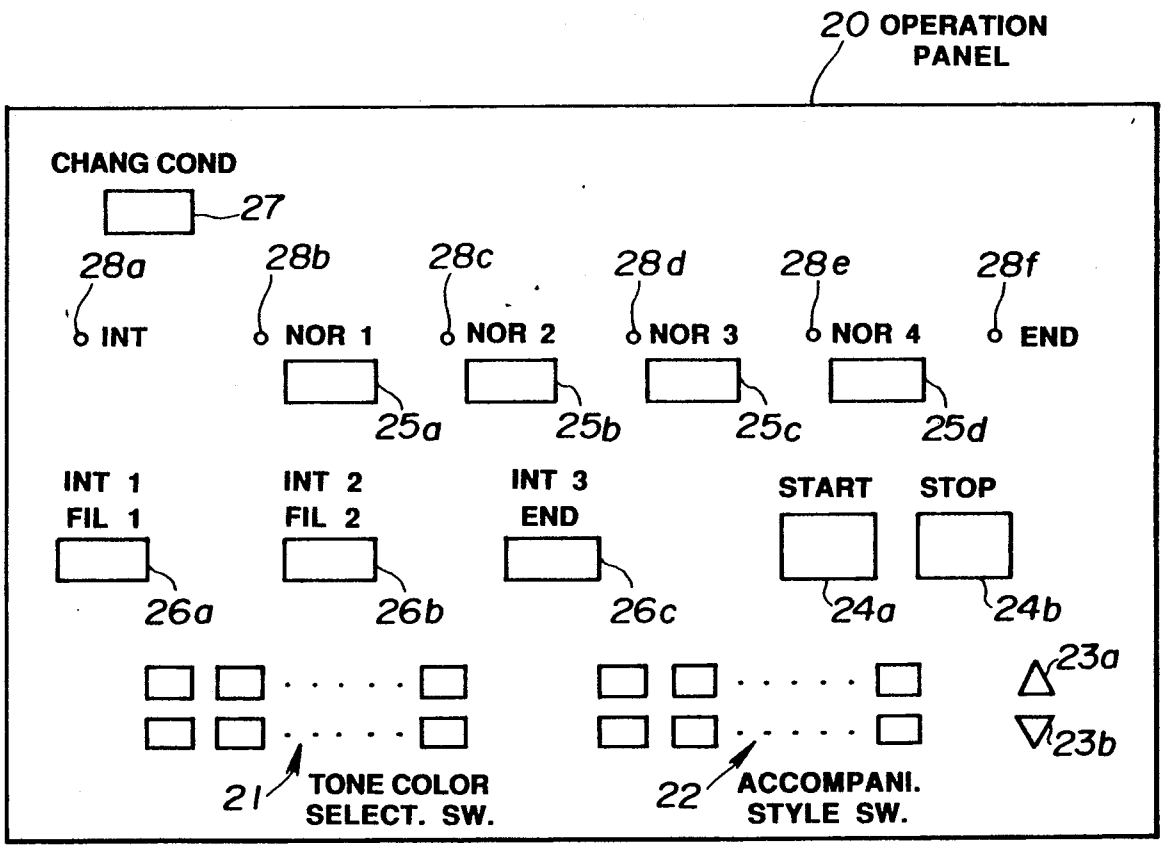
FIG. 3 is a view showing an operation panel of FIG. 2 in detail.

The operation panel 20 has, as shown in FIG. 3, a tone color selection switch group 21 including a number of tone color selection switches, an accompaniment style switch group 22 including a number of accompaniment style switches, a start switch 24*a*, a stop switch 24*b*, four normal pattern switches 25*a*-25*d*, three special pattern switches 26*a*-26*c*, a change condition switch 27 and six lamps 28*a*-28*f*.

Figure 1:
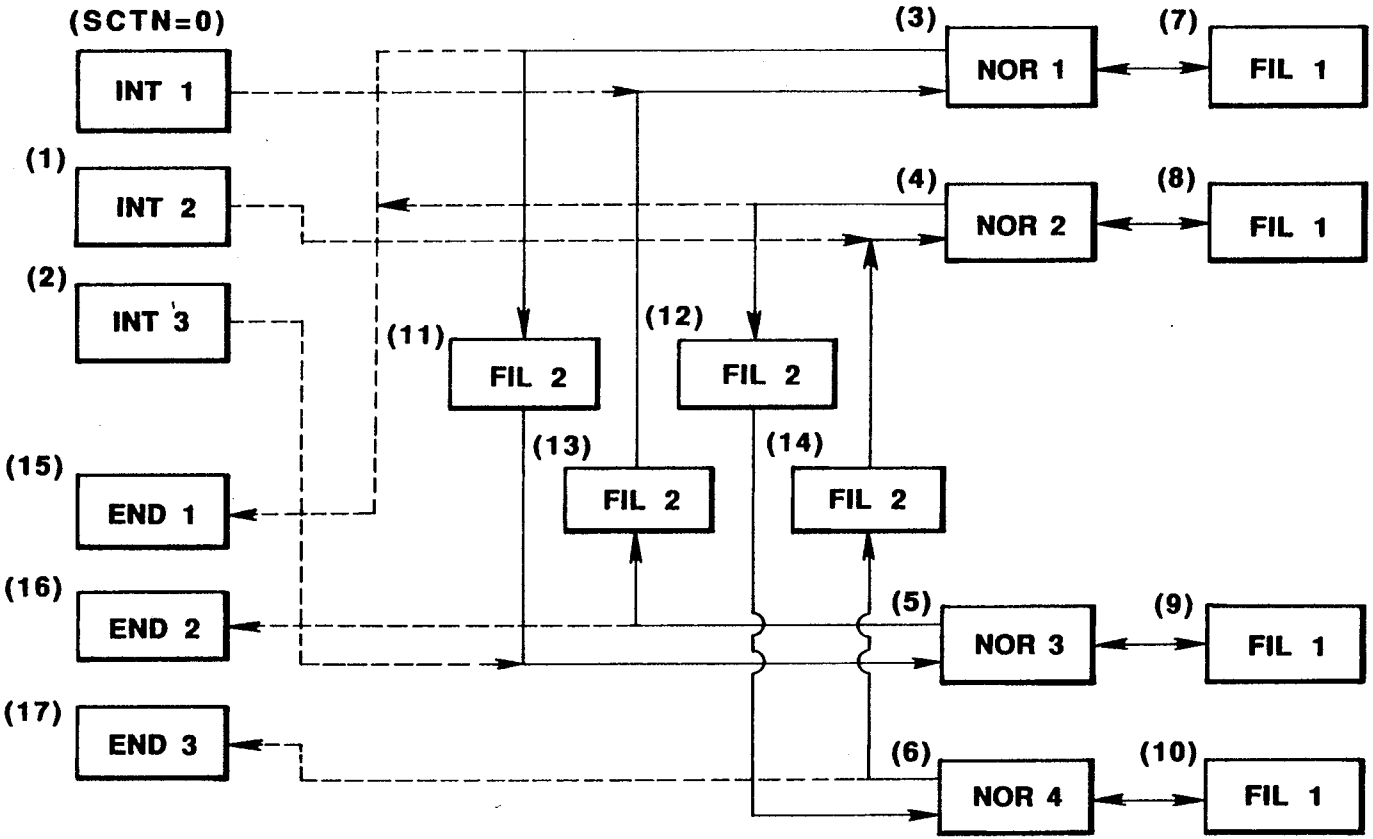
FIG. 1 is a diagram for explaining modes of transfer between various automatic accompaniment patterns.

The respective switches of the tone color selection switch group 21 correspond to tone colors such as violin, guitar and piano. Each of the switch group 21 designates one of these tone colors for a melody tone. The respective switches of the accompaniment style switch group 22 correspond to accompaniment styles such as march, walz and rock. Each of the switch group 22 designates one of these accompaniment styles. The up switch 23*a* and the down switch 23*b* designate rise and fall of the tempo of the automatic accompaniment. The start switch 24*a* designates start of automatic accompaniment and the stop switch 24*b* designates stop of the automatic accompaniment. The normal pattern switches 25*a*-25*d* correspond to four normal patterns NOR1-NOR4 (FIG. 1) and each of these switches designates one of the four normal patterns belonging to the designated accompaniment style. The special pattern switches 26*a*-26*c* correspond to three introduction patterns INT1-INT3 (FIG. 1) and also correspond to first fill-in patterns FIL1, second fill-in patterns FIL2 and ending patterns END1-END4 (FIG. 1). Each of the switches designates one of the three introduction patterns belonging to the designated accompaniment style, or one of the first and second fill-in patterns or one of the ending patterns. The change condition switch 27 designates transfer from the normal pattern to the fill-in pattern or ending pattern with a predetermined condition (i.e., transfer at the first beat or an odd beat) or transfer without any condition. The lamps 28*a*-28*f* are made of light-emitting diodes in which the lamp 28*a* displays that the introduction pattern is being performed, the lamps 28*b*-28*e* display that the first-fourth normal patterns are being performed and the lamp 28*f* displays that the ending pattern is being performed. Operation of the switches 21-27 is detected by a switch operation detection circuit 20*a* and the lamps 28*a*-28*f* are lighted and extinguished by a display control circuit 20*b*.

The key depression detection circuit 13*a*, switch operation detection circuit 20*a* and display control circuit 20*b* are connected to a bus 30. To the bus 30 are also connected a tone signal forming circuit 40, a microcomputer section 50 and an accompaniment data memory 60.

The tone signal forming circuit 40 has plural tone signal forming channels. Each tone signal forming channels produces melody tone signals such as piano and clarinet which change in tone pitch in accordance with control data such as a key code KC, tone color number VOIN, tone volume data VOL and a key-on signal KON which are supplied from the microcomputer section 50 through the bus 30 and also forms and outputs percussion instrument signals for percussion instruments such as drums and cymbales (defined as a part of the accompaniment tone signals in this specification). The output of the tone signal forming circuit 40 is connected to a loudspeaker 42 through an amplifier 41.

The microcomputer section 50 includes a program memory 51, a tempo clock generator 52, a CPU 53 and a working memory 54 respectively connected to the bus 30. The program memory 51 is constructed of a ROM and stores a program corresponding to the flow charts of FIGS. 7-26. The tempo clock generator 52 is constructed of a variable frequency oscillator and generates a tempo clock signal at a period corresponding to control data representing minute time length $\Delta T$ supplied from the CPU 53 through the bus 30. Upon turning on of a power switch (not shown), the CPU 53 continuously performs the program corresponding to the flow charts of FIGS. 7-19 and, upon arrival of the tempo clock signal, stops the program and executes an interrupting program which corresponds to the flow charts of FIGS. 20-26. The working memory 54 is constructed of a RAM and temporarily stores data necessary for executing the programs.

The accompaniment data memory 60 is constructed of a ROM and has a style table STLTBL, a selection table SCTTBL and a performance table PLDT and also has a memory area for other accompaniment data.

Figures 4, 5:
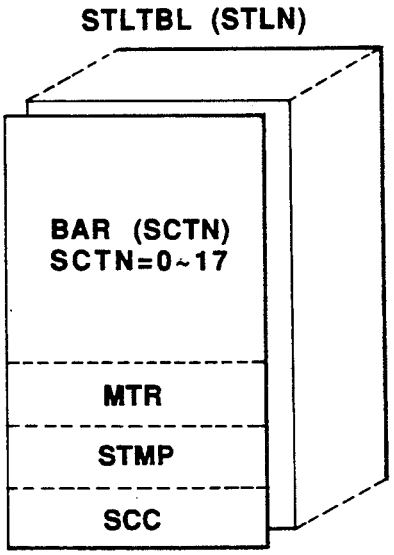
FIG. 4 is a diagram showing a data format of a style table in an accompaniment data memory of FIG. 2.
FIG. 5 is a diagram showing a data format of a section table in the accompaniment data memory of FIG. 2.
Figure 6A:
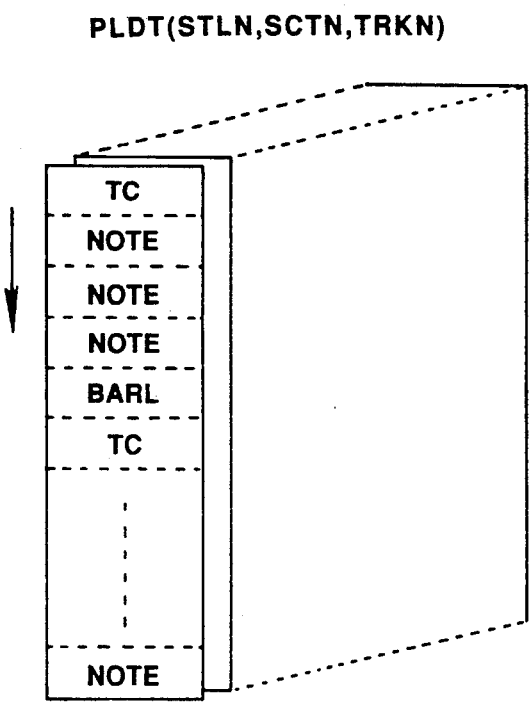
FIGS. 6(A)-(D) are diagrams showing a data format of a performance data table in the accompaniment data memory of FIG. 2.
Figure 6B:
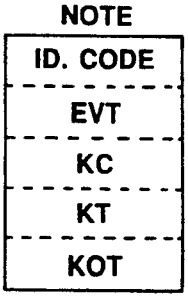
Figure 6C:
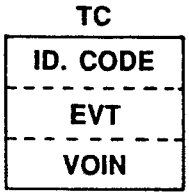
Figure 6D:
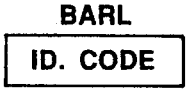

The style table STLTBL is divided in memory areas STLTBL(STLN) corresponding to the respective accompaniment styles shown in FIG. 4 and each memory area STLTBL(STLN) is designated by a style number STLN representing each style. In these memory areas STLTBL(STLN) are stored number of bars for each section BAT(SCTN), number of meter MTR, standard tempo STMP and section change condition SCC. The bar number BAR(SCTN) represents a number of bars for one period of a pattern for each section and is designated by a section number SCTN representing each pattern of 18 patterns for each accompaniment style. As shown in FIG. 1, section numbers 0-2 represent three introduction patterns INT1-INT3, section numbers 3-6 represent four normal patterns NOR1-NOR4, section numbers 7-10 represent four first fill-in patterns FIL1, section numbers 11-14 represent second fill-in patterns FIL2 and section numbers 15-17 represent ending patterns END1-END3. The meter number MTR is set to the number of crotchets in one bar, e.g., "3" in the case of triple time and "4" in the case of quadruple time. The standard tempo STMP represents a standard tempo for each accompaniment style, i.e., a standard number of crotchets per minute. The section change condition SCC represents a condition in the case of transfer from a normal pattern to a fill-in pattern or ending pattern with the condition. When the section change condition SCC is "0", it represents that the transfer is realized upon arrival of an odd beat after turning on of one of the special pattern switches 26*a*-26*c*, whereas when the section change condition SCC is "1", it represents that the transfer is realized upon arrival of the first beat after turning on of one of these switches.

A section table SCTTBL is divided, as shown in FIG. 5, in memory areas SCTTBL(STLN,SCTN) corresponding to the respective accompaniment styles and respective sections. The respective memory areas SCTTBL(STLN,SCTN) are designated by the style number STLN and section number SCTN. In the respective memory areas SCTTBL(STLN,SCTN) are stored bar number BAR and tone volume VOL for each track number TRKN(0-8). The track number TRKN represents a train of tones constituting a chord by 0-6, a train of bass tones and a train of percussion instrument tones by 7 and 8. The bar number BAR(TRKN) represents the number of bars for each period of each track and the tone volume VOL represents relative tone volume of a train of tones for each track.

A performance data table PLDT is divided, as shown in part (A) of FIG. 6, in memory areas PLDT(STLN,SCTN,TRKN) corresponding to respective accompaniment styles, respective sections and respective tracks. The respective memory areas PLDT(STLN,SCTN,TRKN) are designated by the style number STLN, section number SCTN and track number TRKN. In the respective memory areas PLDT(STLN,SCTN,TRKN) are stored a train of performance data including note data NOTE, tone color data TC and bar line data BARL for each track and progressing with lapse of time. The note data NOTE is composed of a set of data consisting of, as shown in part (B) of FIG. 6, an identifying code, event time EVT, key code KC, key touch KT and key-on time KOT. In this case, the identifying code represents that this set of data is note data NOTE. The event time EVT represents reading time of this note data NOTE by time elapsed from the beginning of the bar. The key code KC represents tone pitch of the accompaniment tone by the number of semitone intervals from C tone in a major chord. In case of percussion instruments, it represents the type of percussion instrument. The key touch KT represents relative tone volume of each accompaniment tone and the key-on time KOT represents sustaining time of the accompaniment tone. The tone color data TC is composed of a set of data which consists of, as shown in part (C) FIG. 6, an identifying code, event time EVT and a tone color number VOIN. In this case, the identifying code represents that the set of data is tone color data TC. The event time EVT represents reading timing of the data TC by time elapsed from the beginning of the bar. The tone color number VOIN represents tone color of the accompaniment tone. In the case of a percussion instrument tone, it represents subtle change in the same tone. The bar line data BARL consists of only an identifying code representing that the accompaniment tone train is the end of the bar. These performance data trains are so established that the automatic performance effect is increased in the direction from the upper pattern to the lower pattern in FIG. 1 (i.e., as the section number SCTN increases in the introduction pattern, normal pattern, first and second fill-in pattern and ending pattern). As a result, respective patterns which are connected by solid lines or broken lines in FIG. 1 correspond to one another.

In the area for storing other accompaniment data, there are provided a chord detection table for detecting a chord and a conversion table for converting an accompaniment tone to a chord constituting tone on the basis of the detected chord.

The operation of the above described embodiment will be described with reference to the flow charts.

Figure 7:
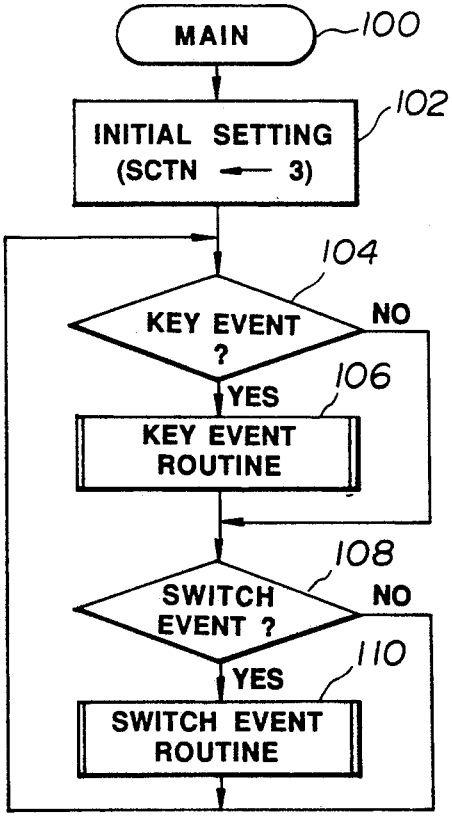
FIG. 7 is a flow chart of "main program" executed by a microcomputer of FIG. 2.
Figure 8:
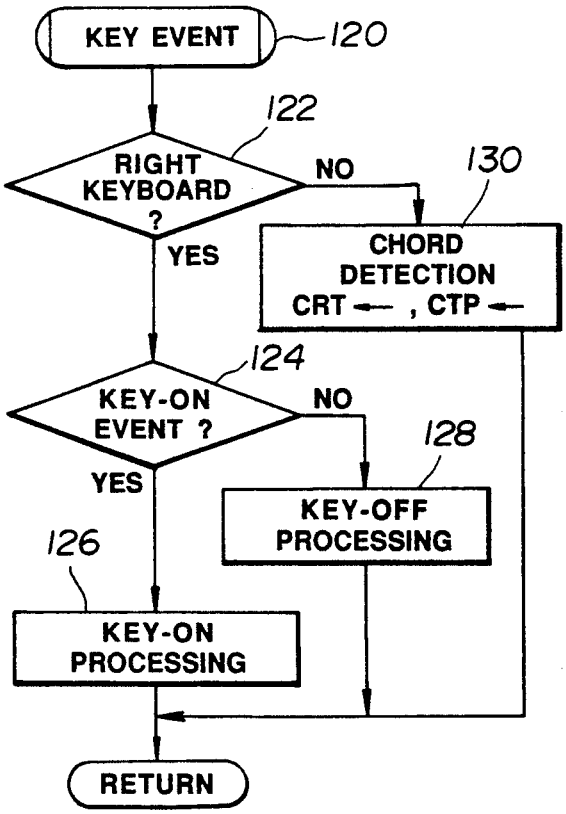
FIG. 8 is a flow chart showing "key event routine" of FIG. 7 in detail.

Upon turning on of a power switch (not shown), the CPU 53 stars execution of the program in step 100 of FIG. 7 and sets the tone signal forming circuit 40 and the working memory 54 to an initial state in step 102. In this initial state setting processing, the section number SCTN if set to "3" indicating the normal pattern NOR1 (see FIG. 1).

After the initial setting, the CPU 53 executes curculating processing of steps 104 to 110. In step 104, the CPU 53 detects operation of a key in either the left keyboard 11 or the right keyboard 12 and also detects operation of one of the switches provided on the operation panel 20. When any key has been operated, the CPU 53 executes "key event routine" of step 106 on the basic of judgement of YES, i.e., there has been a key event, in step 104. This key event routine consists of steps 120 to 132 as shown in detail in FIG. 8. In this routine, generation of a melody tone is controlled and a performed chord is detected as the left and right keyboards 11 and 12 are played. When one of the switches on the operation panel has been operated, the "switch event routine" is executed in step 110 on the basic of YES in step 108. This switch event routine consists of steps 140–166 as shown in detail in FIG. 9 in which the tone color of a melody tone is established and generation of the accompaniment tone is controlled.

Generation of a melody tone and accompaniment tone will now be described item by item.

a. Generation of a Melody Tone and Detection of a Chord

When one of the keys of the left keyboard 11 and the right keyboard 12 is operated, the CPU 53 executes, as described above, processing of the key event routine (FIG. 8) in step 106. When one of the keys of the right keyboard 12 has been depressed, the CPU 53 judges YES in both steps 122 and 124 and executes the key-on processing in step 126. In this key-on processing, the key code KC representing the key name of the depressed key and the key-on signal KON are supplied to the tone signal forming circuit 40 which in turn produces a melody signal having a tone pitch indicated by the key code KC and supplies it to the loudspeaker 42 through the amplifier 41. When one of the keys of the right keyboard 12 has been released, the CPU 53 judges YES in step 122 and NO in step 124 and executes the key-off processing in step 128. In this key-off processing, the key code KC representing the released key and the key-off signal KOF are supplied to the tone signal forming circuit 40 which in turn stops production of the melody signal indicated by the key code KC. The melody tone thereby is sounded from the loudspeaker 42 in accordance with performance of the right keyboard 12. In this case, tone color of the melody tone is selected by operation of the tone color selection switch group 21. When any one of the switch group 21 has been operated, the CPU 53 executes, as described above, processing of the switch event routine (FIG. 9) in step 110 of the main program. In this witch event routine, tone color number data VOIN representing the tone color selection switch 21 which as been operated is supplied to the tone signal forming circuit 40 in step 144 on the basis of the judgement made in step 142 and the tone signal forming circuit 40 control the tone color of the melody tone.

On the other hand, when any one of the keys of the left keyboard 11 has been depressed or released, the CPU 53 judges NO in step 122 in the key event routine (FIG. 8) as described above and executes chord detection processing in step 130. In this processing, the chord detection table in the accompaniment data memory 60 is referred to in accordance with combination of keys depressed in the left keyboard 11 and a chord is detected and, simultaneously, data representing the root note and the type of the detected chord are stored as chord root note CRT and chord type CTP.

b. Setting of the Accompaniment Style, Tempo and Change Condition Flag

When either one switch of the accompaniment style switch group 22, up switch 23*a*, down switch 23*b* or change condition switch 27 has been operated, as described above, the CPU 53 executes the switch event routine (FIG. 9) in step 110 (FIG. 7).

Figure 9:
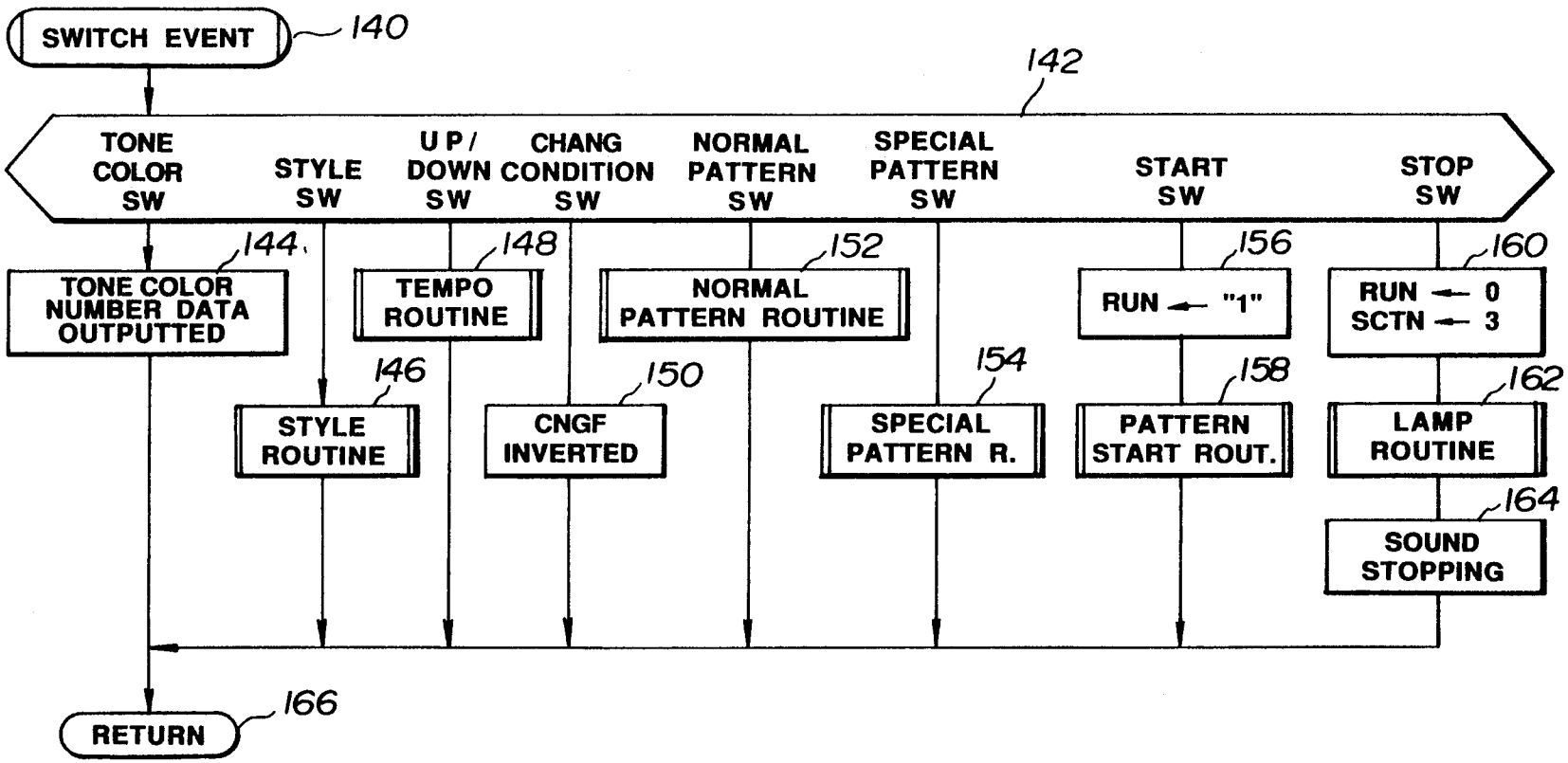
FIG. 9 is a flow chart showing "switch event routine" of FIG. 7 in detail.
Figure 10:
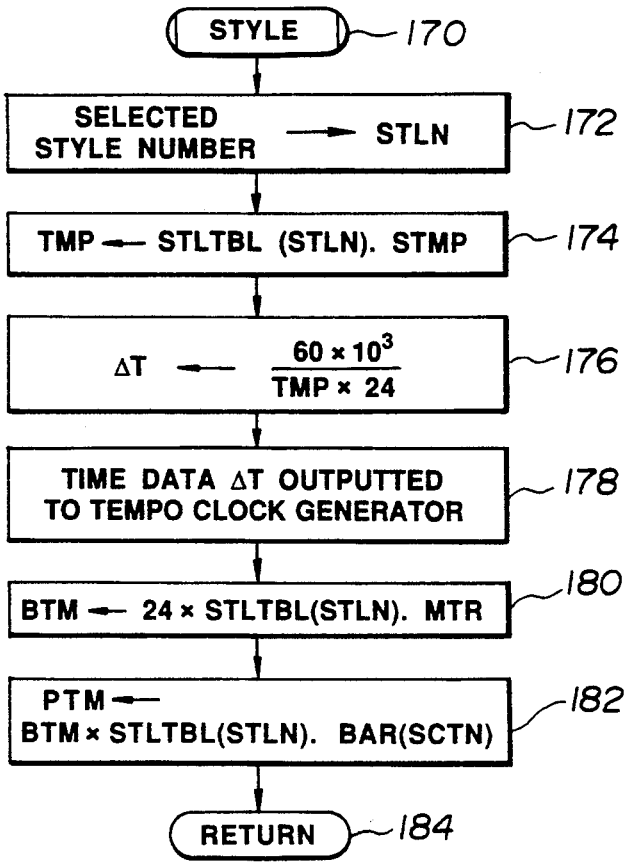
FIG. 10 is a flow chart showing "style routine" of FIG. 9 in detail.
Figure 11:
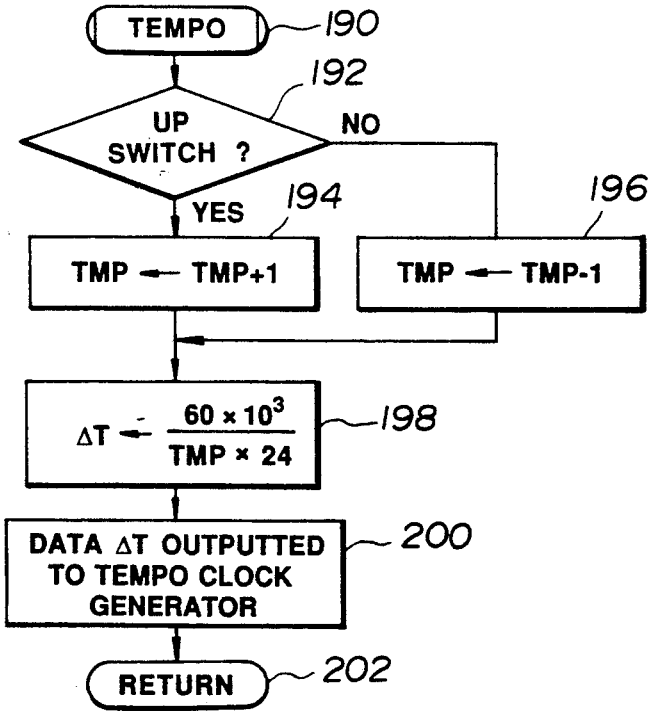
FIG. 11 is a flow chart showing "tempo routine" of FIG. 9 in detail.

When one of the accompaniment style switch group 22 has been operated, the CPU 53 executes "style routine" in step 146 on the basis of the judgement in step 142 (FIG. 9). In this style routine, as shown in detail in FIG. 10, the execution of this routine is started in step 170, the number representing the accompaniment style switch 22 which has been operated is stored as the style number STLN in step 172, the style table STLTBL in the accompaniment data memory 60 is referred to in step 174, and the standard tempo STLTBL(STLN).STMP in the table STLTBL which is designated by the style number STLN is read out and stored as the tempo TMP determining the speed of the automatic accompaniment. These standard tempo STLTBL(STLN).STMP and tempo TMP represent the numbers of crotchets per minute.

Then, by execution of the operation shown in the following formula (1) using the tempo TMP in step 176, minute time length ΔT is computer and data representing the time length is supplied to a tempo clock generator 52 in step 178.

$$\Delta T=(60\times 10^3/(TMP\times 24) \quad (1)$$

In this case, the minute time length ΔT represents time corresponding to 1/24 of a crotchet by a unit of millisecond. The tempo clock generator 52 supplies the tempo clock signal to the CPU 53 at each minute time length ΔT.

After setting of the tempo, the style table (FIG. 4) is referred to and meter number STLTBL(STLN).MTR and bar number STLTBL(STLN).BAR(SCTN) designated respectively by the section number SCTN are read from the table in steps 180 and 182. By execution of the following formula (2), one bar time BTM and one pattern time PTM are computed and execution of the style routine is finished in step 184.

$$BTM=24\times STL(STLN).MTR$$

$$PTM=BTM\times STLBTL(STLN).BAR(SCTN) \quad (2)$$

In this case, one bar time BTM represents the number of tempo clock signals counted during one bar in the selected accompaniment style and one pattern time PTM represents the number of tempo clock signals counted during one pattern in the designated section number SCTN in the same style.

Upon operation of the up switch 23*a* or the down switch 23*b*, the CPU 53 executes "tempo routine" in step 148 on the basis of the judgement in step 142 (FIG. 9). In this tempo routine, as shown in detail in FIG. 11, execution of the routine is started in step 190 and whether the up switch 23*a* or the down switch 23*b* has been operated is detected in step 192. When the up switch 23*a* has been operated, "1" is added to the tempo TMP in step 194 on the basis of the judgement of YES in step 192 whereas when the down switch has been operated, "1" is subtracted from the tempo TMP in step 196 on the basis of the judgement of NO in step 192. After the processing of steps 194 and 196, the minute time length ΔT is changed in accordance with the tempo TMP in steps 198 and 200 in the same processing as in steps 176 and 178 and control data representing the changed minute time length ΔT is supplied to the tempo clock generator 52. The standard speed of accompaniment of the selected accompaniment style can thereby be changed as desired by the player by operating the up switch 23*a* and the down switch 23*b*.

Upon operation of the change condition switch 27, the CPU 53 inverts a change condition flag CNGF (from "1" to "0" or from "0" to "1") at each operation in step 150 on the basis of the judgement of step 42 (FIG. 9). In this case, the state "0" of the change condition flag CNGF represents a transfer without condition mode, i.e., a mode of transfer from the normal pattern to the fill-in pattern or ending pattern immediately after turning on of the special pattern switches 26*a*–26*c*. The state "1" of the change condition flag CNGF represents a transfer with condition mode, i.e., a mode in which the pattern is transferred at next odd beat or the first beat after turning on of the special pattern switches 26*a*–26*c*.

c. Normal Pattern Performance

In a case where a normal pattern performance is to be made, the player selects a desired accompaniment style by one of the accompaniment switch group 22 on the operation panel 20 and selects a desired normal pattern by one of the normal pattern switches 25*a*–25*d* and then operates the start switch 24*a*.

The operation when one of the accompaniment style switch group 22 has been operated is described above. By this operation, the style number STLN, the period of the tempo clock signal from the tempo clock generator 52, one bar time BTM and one pattern time PTM are established in accordance with the selected accompaniment style.

When one of the normal pattern switches 25*a*–25*d* has been operated, the CPU 53 executes "normal pattern routine" in step 152 on the basis of the judgement in step 142 (FIG. 9). In this normal pattern routine, as shown in detail in FIG. 12, execution of the routine is started in step 210 and one of section numbers 3–6 (indicated at left side space above each box of FIG. 1) representing the operated one of the normal pattern switches 25*a*–25*d* is temporarily stored as variable i in step 212. Then, in step 214, whether the automatic accompaniment performance is in operation or not is judged on the basis of a run flag RUN. The run flag RUN indicates that the automatic accompaniment performance is not in operation by "0" and that it is in operation by "1". Since the automatic accompaniment performance is currently not in operation and so that flag RUN is "0", the section number SCTN is set to the variable i in step 224 on the basic of the judgement of NO in step 214. After setting of this section number SCNT, "pattern transfer routine" is executed in step 226 and execution of the normal pattern routine is finished in step 228.

Figure 17:
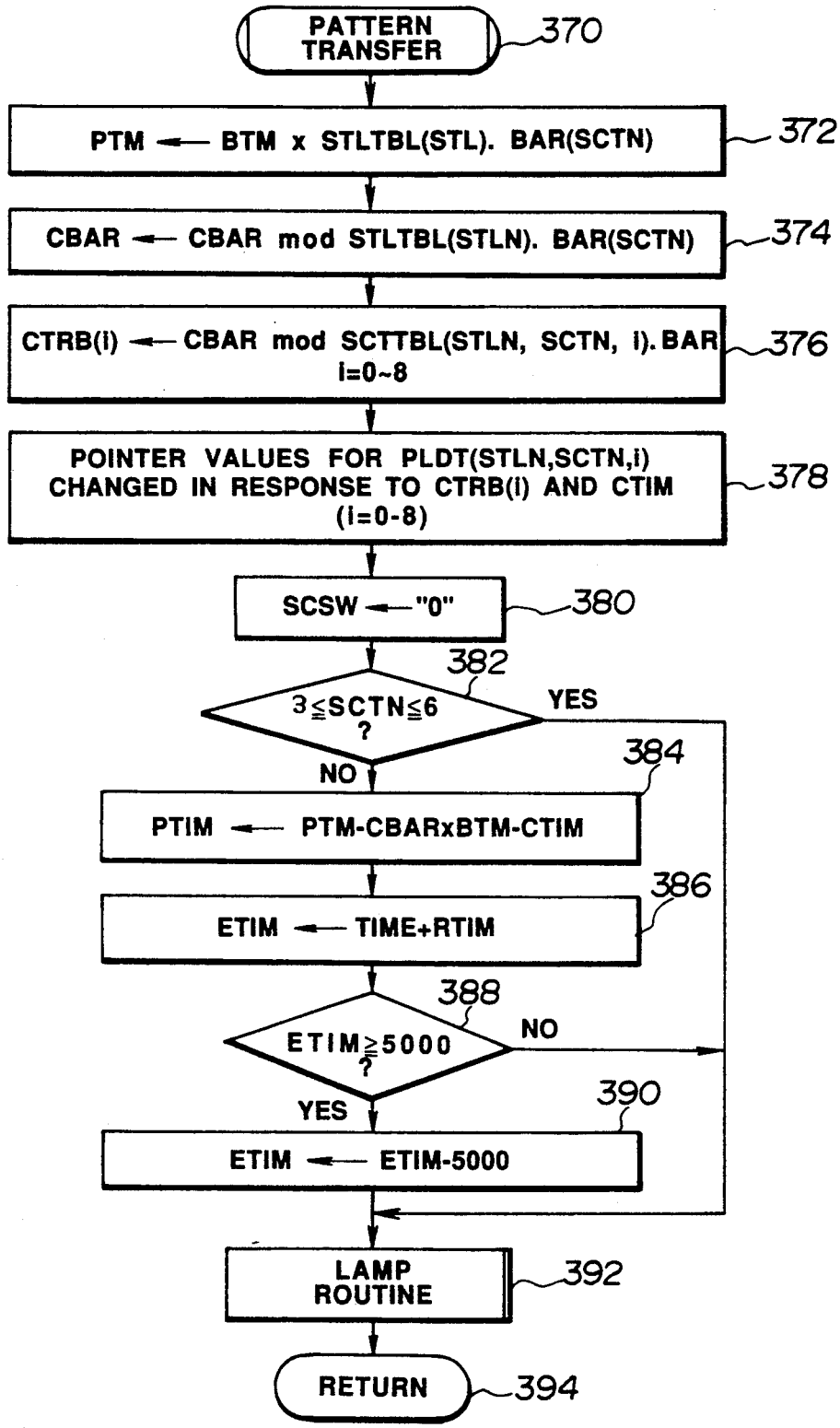
FIG. 17 is a flow chart showing "pattern transfer routine" of FIGS. 12, 14-16, 19, 21 and 22 in detail.
Figure 18:
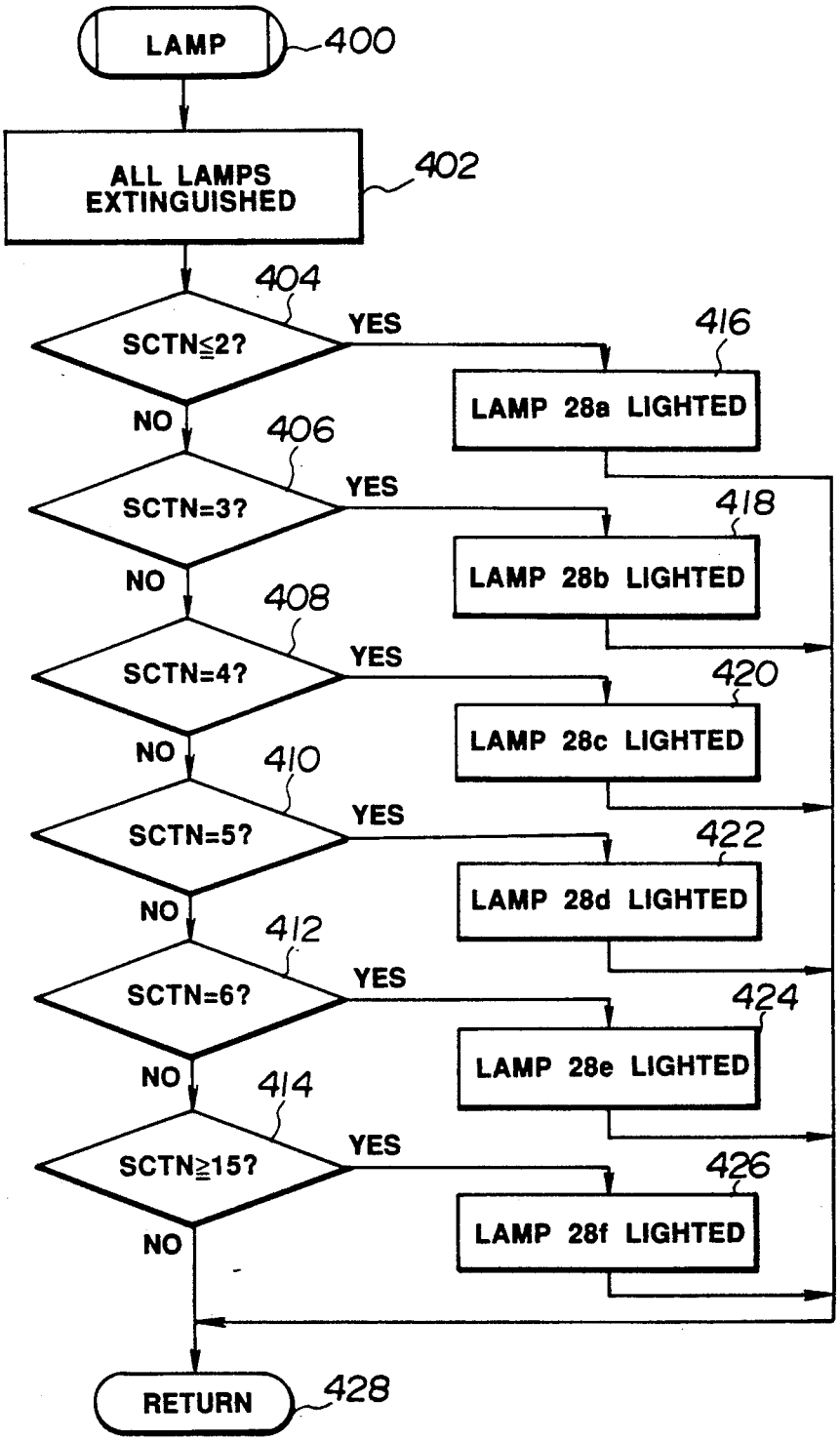
FIG. 18 is a flow chart showing "lamp routine" of FIGS. 9, 17 and 22 in detail.
Figure 19:
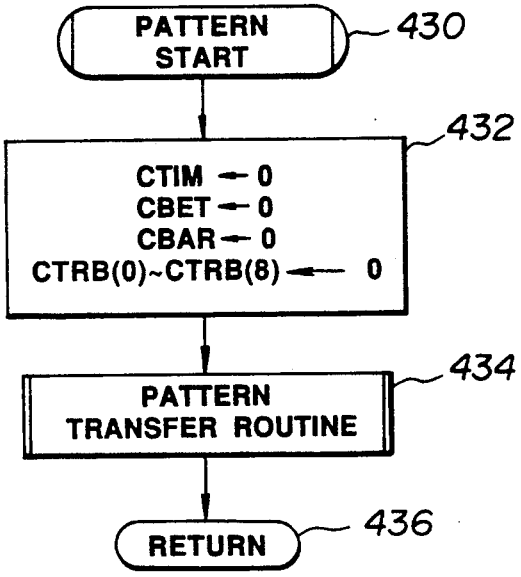
FIG. 19 is a flow chart showing "pattern start routine" of FIGS. 9 and 14-16 in detail.

The pattern transfer routine includes steps 370–394 as shown in detail in FIG. 17. The processing of steps 372–390 is one which is necessary during operation of the automatic accompaniment and unnecessary before the operation thereof, so that description of steps 372–390 in detail will be omitted. After processing of these steps 372–390, "lamp routine" is executed in step 392. In this lamp routine, as shown in detail in FIG. 18, execution of the routine is started in step 400, the CPU 53 extinguishes all lamps 28*a*–28*f* in step 402 and, on the basis of the set section number SCTN (one of 3–6), makes judgement of YES in one of steps 406–412, and lights one of the lamps 28*a*–28*e* in one of steps 416–424. The lamps 28*a*–28*e* are lighted in correspondence to selection of the normal patterns NOR1–NOR4.

Upon operation of the start switch 24*a*, the CPU 53 sets the run flat RUN to "1" in step 156 on the basis of the judgement in step 142 (FIG. 7) and executes "pattern start routine" in step 158. In this pattern start routine, as shown in detail in FIG. 19, execution of the routine is started in step 430 and current timing CTIM, current beat CBET, current bar CBAR and current track bar CRTB(0)–CRTB(8) are set respectively to an initial value "0". These variables CTIM, CBET, CBAR and CRTB(0)–CRTB(8) represent position in progress in the automatic accompaniment performance. The current timing CTIM represents each timing in progress 0–95 (quadruple time), 0–71 (triple time) of 1/24 of one crotchet in each bar. The current beat CBET represents beat in progress 0–3 (Quadruple time), 0–2 (triple time) in each bar. The current bar CBAR represents bar in progress 0–n–1 (n being the number of bar corresponding to the repeating period in each track) in each pattern. The current track bar CRTB(0)–CRTB(8) represents the number of bar 0–n–1 (n being the number of bar corresponding to the repeating period in each track). After initial setting of these variables CTIM, CBET;, CBAR and CRTB(0)–CRTB(8), processing of "pattern transfer routine" is executed in step 434 and execution of the pattern start routine is finished in step 436.

Execution of the pattern transfer routine is started, as described before, in step 370 of FIG. 17 and, in steps 372–376, one pattern time PTM, current bar CBAR and current track bar CRTB(0)–CRTB(8) are renewed by operation of the following formulas (3).

$$PTM = BTM \times STLTBL(STLN).BAR(SCTN)$$

$$CBAR = CBAR \bmod STLTBL(STLN).BAR(SCTN)$$

$$CTRB(i) = \mathrm{CBAR} \bmod SCTTBL(\mathrm{STLN,SCTN,i}).BAR \qquad (3)$$

In the above formulas (3), the operator mod signifies that the value before the operator mod is divided by the value after the operator mod and the variable i varies over a range of 0–8. By this arrangement, the one pattern time PTM is set to a value corresponding to the section number SCTN which is set by operation of one of the normal pattern switches 25*a*–25*d*. Since, in this case, the current bar CBAR and the current track bar CRTB(0)–CRTB(8) have been set to "0" by the initial setting processing, these values are maintained at "0" even by execution of the above operations.

Then, in step 378, 9 pointer values for reading out performance data in one of the memory areas PLDT(STLN,SCTN,0)–PLDT(STLN,SCTN.8) for the respective tracks designated by the style number STLN and section number SCTN are respectively changed in accordance with the current track bar CTRB(0)–CTRB(8) and the current timing CTIM. Since the current rack bar CTRB(0)–CTRB(8) and the current timing CTIM are respectively "0" in this case, the respective pointers are set to values representing the head addresses of the respective memory areas PLDT(STLN.SCTN.0)–PLDT(STLN.SCTN.8). After execution of this step 378, the section switch flag SCSW is initially set to "0" in step 390. In step 382, judgement of YES, i.e., the section number SCTN is $3 \leqq SCTN \leqq 6$, is made and, after execution of the above described step 302, the processing of the pattern transfer routine is finished in step 394. In this case also, lighting and extinguishing of the lamps 28*a*–28*e* are controlled by execution of the lamp routine but the state of the lamps 28*a*–28*e* is not changed because the section number SCTN is maintained at the previous value of 3–6.

Figure 20:
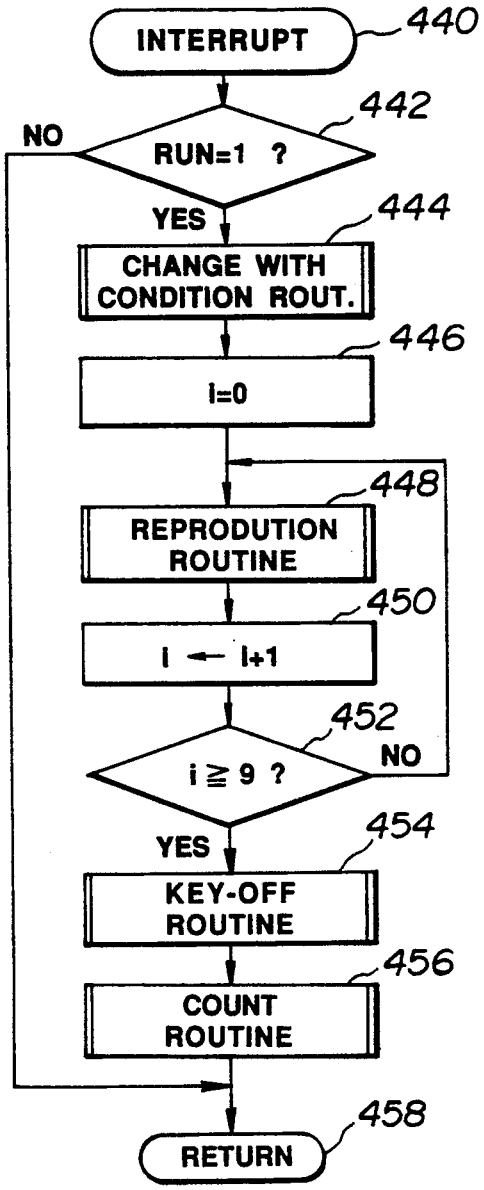
FIG. 20 is a flow chart of "interrupt program" executed by the the microcomputer section of FIG. 2.
Figure 21:
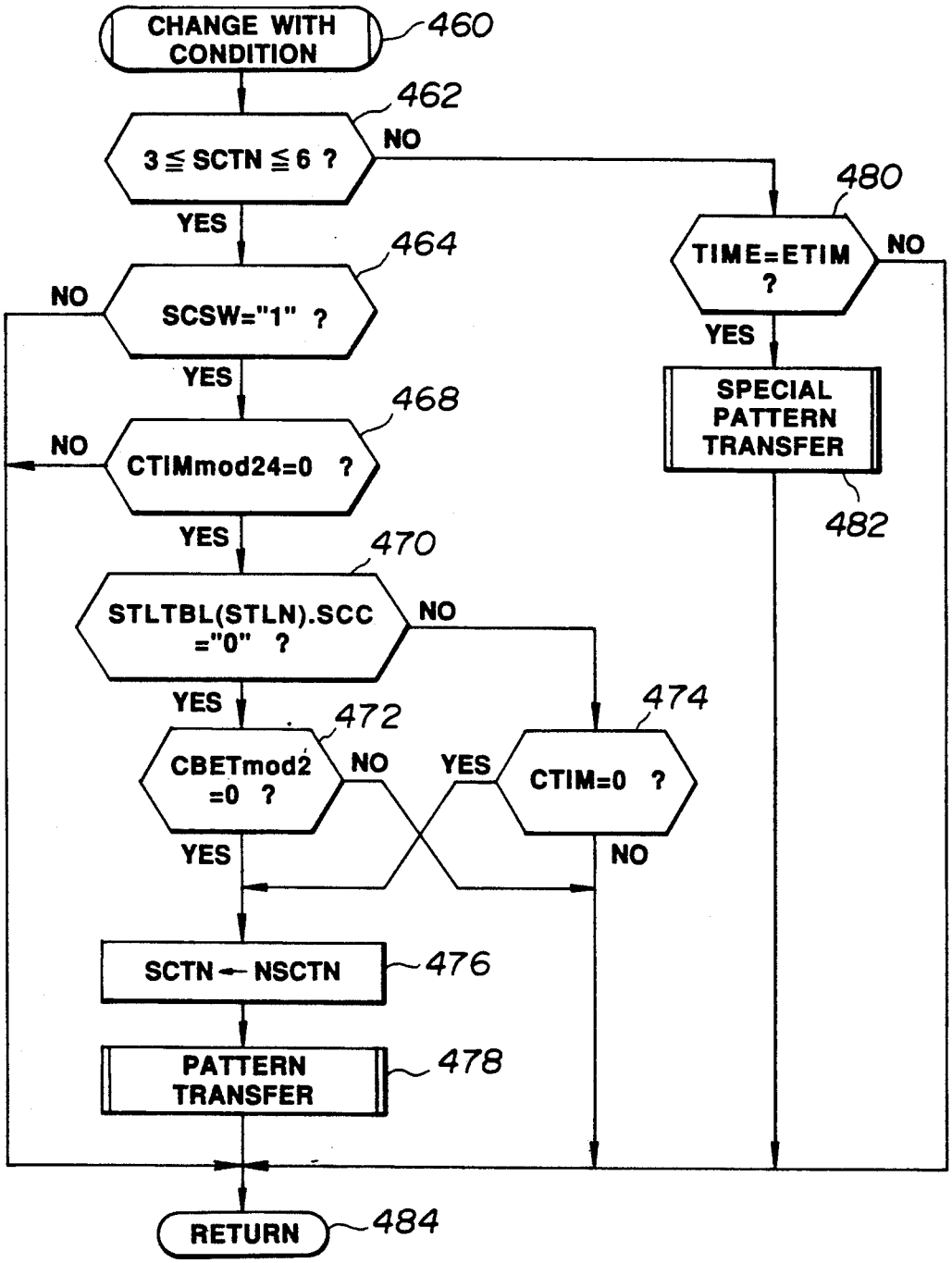
FIG. 21 is a flow chart showing "change with condition routine" of FIG. 20 in detail.
Figure 22:
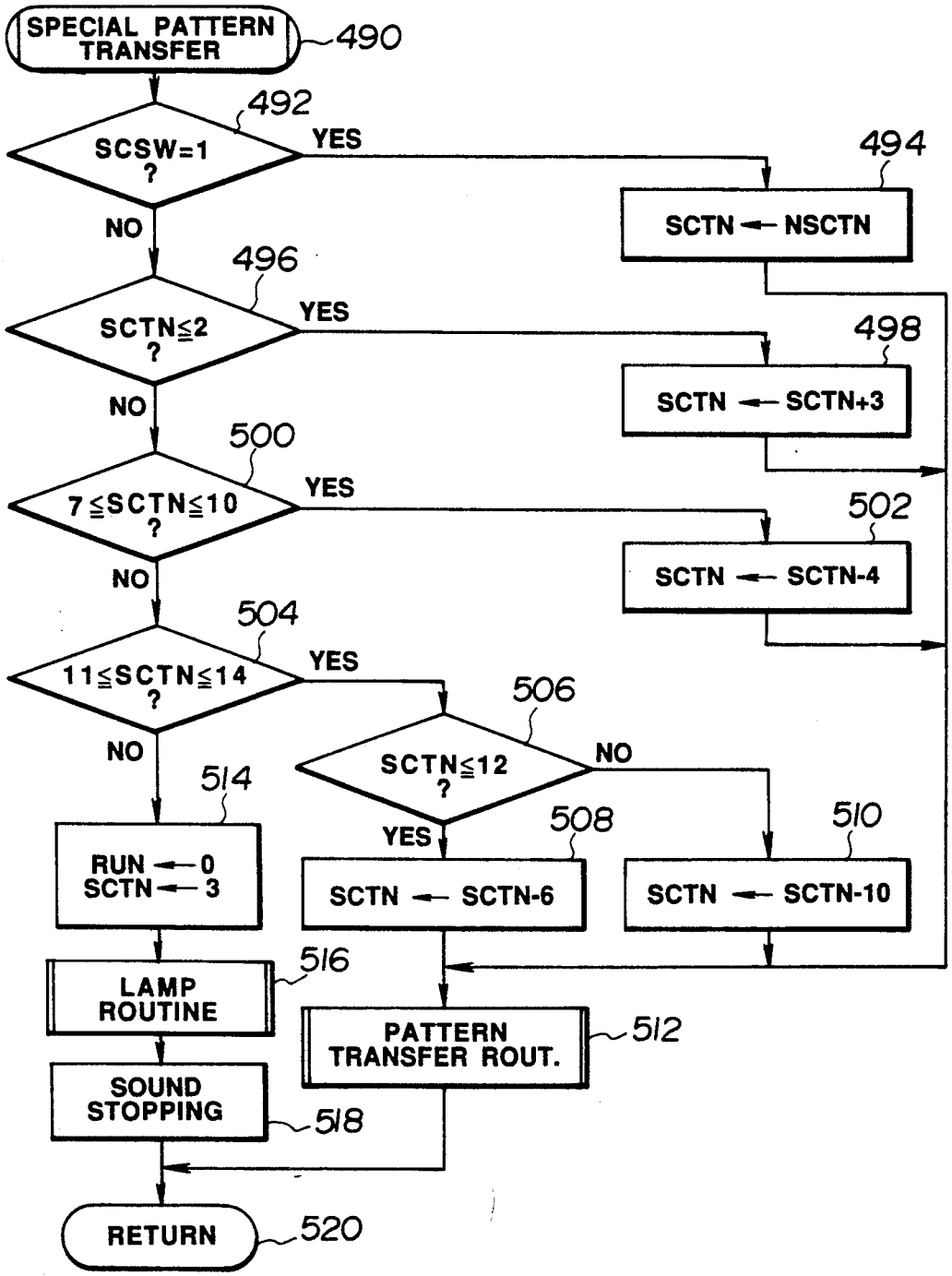
FIG. 22 is a flow chart showing "special pattern transfer routine" of FIG. 21 in detail.

When, in this state, the tempo clock generator 52 has supplied the tempo clock signal to the CPU 53 at each minute time length ΔT, the CPU 53 interrupts execution of the main program at each minute time length ΔT and starts execution of "interrupt program" in step 440 of FIG. 20. In step 442, the CPU 53 judges YES on the basis of the run flag RUN which was set in "1" and executes processing of steps 444–458. In step 444, "change with condition routine" shown in FIG. 21 is executed. In step 462, judgement of YES, i.e., the section number SCTN is $3 \leqq SCTN \leqq 6$, is made and in step 464, judgement of NO, i.e., section flag SCSW is not "1", is made and the change with condition routine is finished in step 484. In this case, therefore, no substantial execution of this routine is made.

Figure 23:
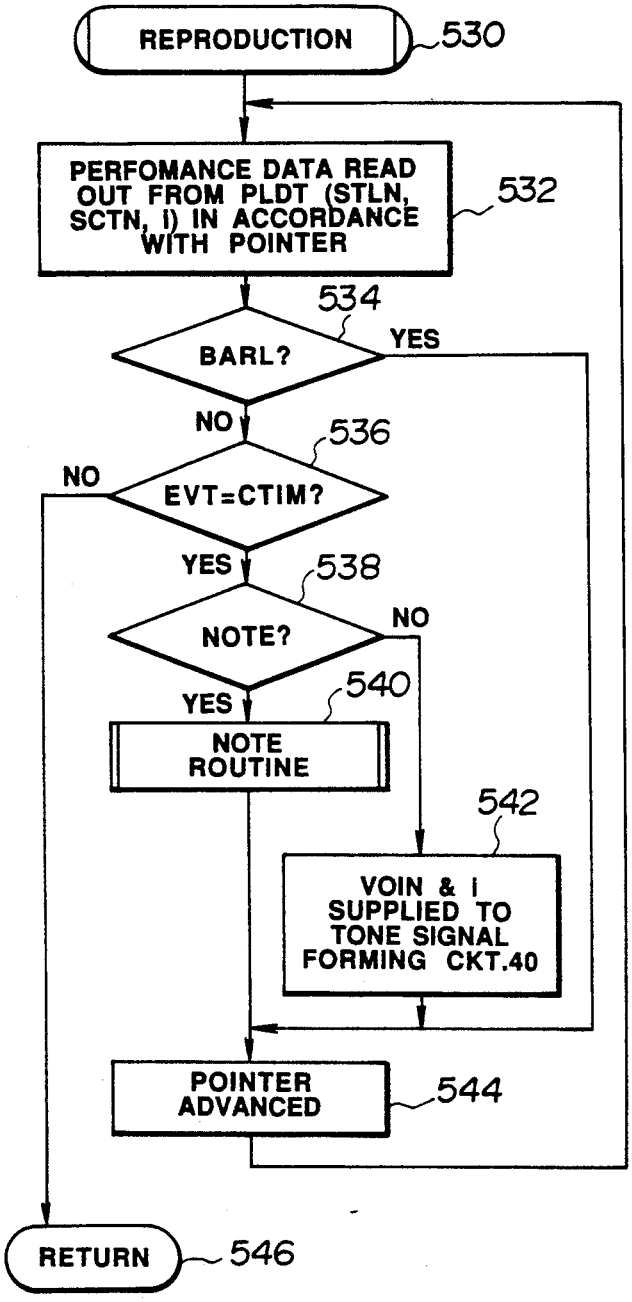
FIG. 23 is a flow chart showing "reproduction routine" of FIG. 20 in detail.
Figure 25:
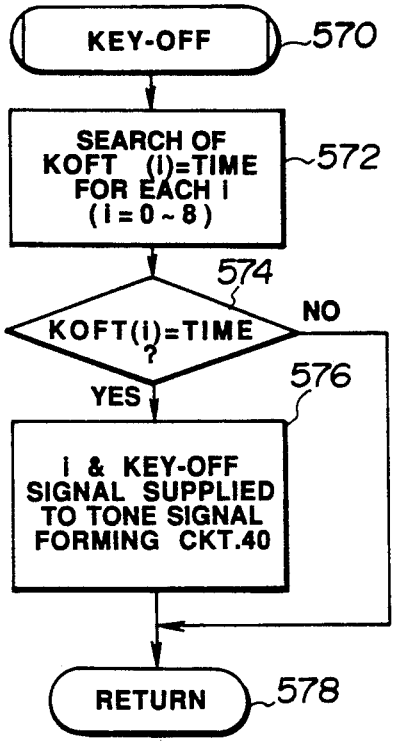
FIG. 25 is a flow chart showing "key-off routine" of FIG. 20 in detail.

Then, the CPU 53 increases the variable i from "0" to "8" by "1" each time in steps 446, 450 and 452 while the CPU executes "reproduction routine" repeatedly in step 448. In this reproduction routine, as shown in FIG. 23, execution of the routine is started in step 530. In step 532, a set of performance data designated by the pointer for each track is sequentially read from each memory area PLDT(STLN, SCTN, i) designated by the style number STLN, section number SCTN and variable i representing each track and processing of step 534 and thereafter is executed.

When, n this case, the set of performance data is the bar line data BARL, step 534 is judged to be YES and, in step 544, the pointer of this track is advanced and the program returns to step 532 again to read out next performance data of the same track. When the set of performance data is note data NOTE and its event time EVT is equal to the current timing CTIM, judgements of NO, YES and YES are respectively made in steps 534, 536 and 538 and "note routine" is executed in step 540 to control generation of a tone. When the set of performance data is tone color data and its event time EVT is equal to the current timing CTIM, judgements of NO, YES and NO are made in steps 534, 536 and 538 and tone color of a tone generated is controlled in step 542. After processing of these steps 540 and 542, the pointer of the track is also advanced in step 544 and the program returns to step 532 again to read out next performance data of the same track. When, on the other hand, the set of performance data is note data NOTE or tone color data TC and its event time EVT is not equal to the current timing CTIM, judgement of NO is made in both steps 534 and 536 and the reproduction routine is finished in step 546. By this routine, the note data NOTE and tone color data TC stored in the memory areas PLDT(STLN, SCTN,0)–PLDT(STLN, SCTN,8) are sequentially read out by designation by the pointer and, each time their event time EVT becomes equal to the current timing CTIM, generation of a tone and tone color of the generated tone are controlled.

Control of tone generation and control of tone color of the generated tone will now be described more in detail. As to the control of tone color, in the processing of step 542, a tone color number VOIN and variable i in the tone color data TC are supplied to the tone signal forming circuit 40. The tone signal forming circuit 40 controls, on the basis of the tone color number VOIN and variable i, the tone color of the accompaniment tone of the track designated by the variable i to a tone color designated by the tone color number VOIN.

Figure 24:
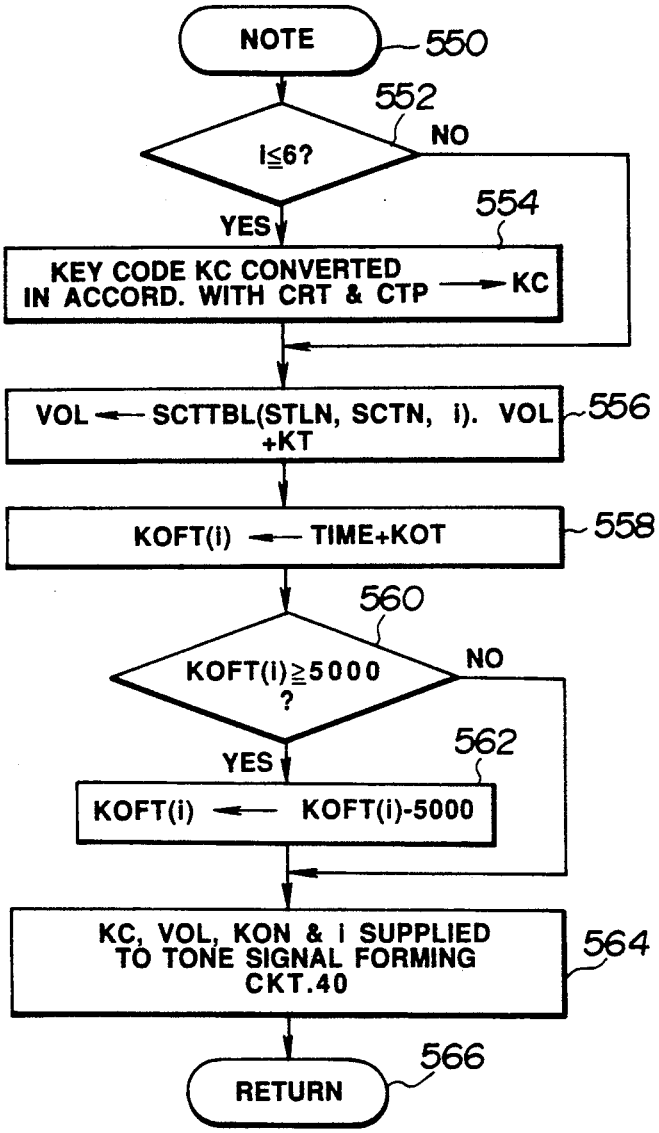
FIG. 24 is a flow chart showing "note routine" of FIG. 23 in detail.

The note routine of step 540 is started in step 550 of FIG. 24. When the variable is "6" or below, judgement of YES is made in step 552 and, in step 554, the key code KC constituting the read out note data NOTE is converted to a key code KC which represents a chord constituting tone corresponding to the chord performed in the left keyboard 11 or a key code KC which represents a bass tone in accordance with the detected chord root note CRT and chord type CTP. When the variable i is "7" or more, judgement of NO is made in step 552 and the conversion processing in step 554 is not executed. This is because the variable i represents a track of a train of chord constituting tones and a track of a train of bass tones when it is 0–6 and represents a train of percussion instrument tones when it is 7 or 8 (FIG. 5). Then, in steps 556 and 558, tone volume VOL and key-off time KOFT(i) are computed by operation of the following formulas (4) based on tone volume data VOL (FIG. 5) in the section table SCTTBL(STLN,SCTN,i) designated by the style number STLN, section number SCTN and variable i (track number) and key-on time KOT and key touch KT in the read out note data NOTE (FIG. 6).

$$VOL = SCTTBL(STLN,SCTN,i).VOL + KT$$

$$KOFT(i) = TIM = KOT \qquad (4)$$

In this case, the time TIME represents absolute time elapsed which counts up from 0 to 5000 in "count routine" to be described later and the key-off time KOFT(i) defines the finish timing of generation of the tone on the basis of this absolute time. After processing of step 558, when the key-off time KOFT(i) has become larger than "5000" as a result of the operation of the formulas (4) in steps 560 and 562, the key-off time is changed to a value below "5000" by subtracting "5000" from the value of the key-off time KOFT(i).

Then, in step 564, the converted key code KC (if the variable i is 7 or 8, unconverted key code KC), tone volume VOL, key-on signal KON and variable i are supplied to the tone signal forming circuit 40 and the note routine is ended in step 566. The tone signal forming circuit 40 forms an accompaniment tone signal of the track designated by the variable i on the basis of the key code KC, tone volume VOL, key-on signal KON and variable i and supplies the signal to the loudspeaker 42 through the amplifier 41. In this case, the tone pitch of the accompaniment tone signal is one designated by the key code KC (when the variable i is 7 or 8, the type of percussion instrument is designated by the key code KC), the tone color of the accompaniment tone signal is one set by the tone color number VOIN and the tone volume of the accompaniment tone signal is one designated by the volume VOL. Consequently, the loudspeaker 42 sounds a series of accompaniment tones constituting of chord constituting tones, bass tones and percussion instrument tones.

Reverting to the interrupt program of FIG. 20, after processing of steps 446–452, "key-off routine" is executed in step 454 and "count routine" is executed in step 456. The key-off routine consists of steps 570–578 as shown in detail in FIG. 25. In steps 572–576, key-off time KOFT(i) which coincides with time TIME is searched while variable i is changed from 0 to 8 and, as a result, variable i concerning the key-off time KOFT(i) which has coincided and the key-off signal are supplied to the tone signal forming circuit 40. The tone signal forming circuit 40 finishes forming of the accompaniment tone signal represented of the track indicated by the variable i and, therefore, sounding of an accompaniment tone corresponding to the accompaniment tone signal from the loudspeaker 42 is finished.

Figure 26:
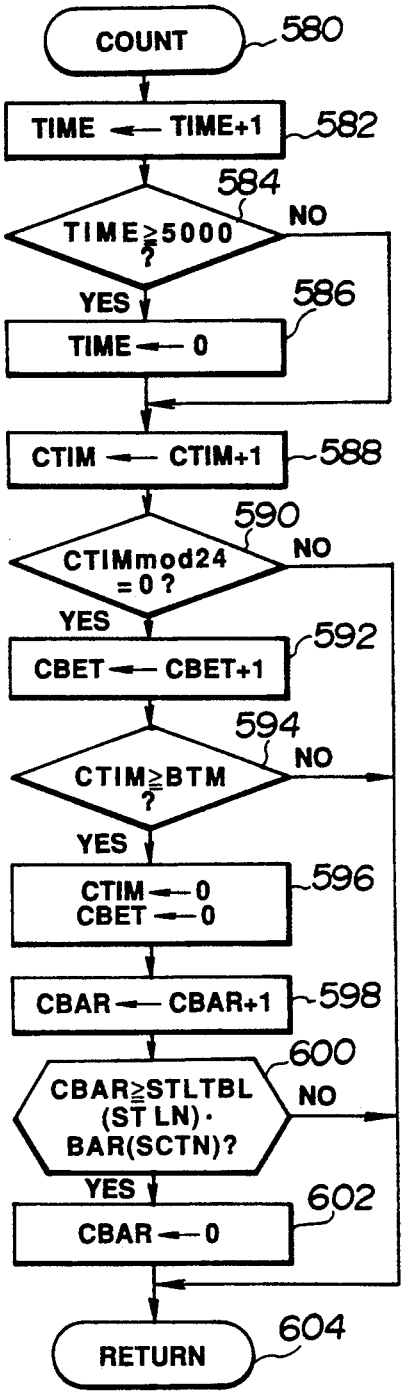
FIG. 26 is a flow chart showing "count routine" of FIG. 20 in detail.

The count routine is shown in detail in FIG. 26. Execution of the count routine is started in step 580. By processing in steps 582 and 588, the time TIME and current timing CTIM are counted up by "1". The time TIME is cleared to "0" when it has reached "5000" by processing of steps 584 and 586 and the current timing CTIM is cleared to "0" when it has reached one bar time BTM by processing of steps 594 and 596. By these processing, each time the tempo clock signal generator 52 generates the tempo clock signal, i.e., at each timing of 1/24 of one crotchet, the time TIME increases by "1" sequentially from "0" to "4999". This value "4999" has no particular meaning in itself but it may be any value so long as it is much larger than other variables representing time. The current timing CTIM increases by "1" from "0" to "95" (from "0" to "71" in the case of triple time) at each above described timing during each bar. The current beat CBET increases by "1" from "0" to "3" (from "0" to "2" in the case of triple time) at each beat (length of one crotchet) during each bar by processing of steps 590–596. The current bar CBAR increases by "1" from "0" to the number of bar "STLTBL(STLN).BAR(SCTN) −1" during one bar time BTM over one period of the pattern designated by the style number STLN and section number SCTN by processing of steps 594 and 598–602.

As described in the foregoing, by operation of the accompaniment switch group 22, normal pattern switches **25*a*–25*d* and start switch 24*a*, the accompaniment style and normal pattern (one of NOR1–NOR4) are designated and the automatic accompaniment is started. Each time the tempo clock signal generator 52 generates a tempo clock signal (at each timing of 1/24 of one crotchet), the interrupt program is executed during which the time TIME, current timing CTIM, current beat CBET and current bar CBAR are sequentially renewed and performance data in the accompaniment data memory 60** is read out whereby generation of an accompaniment tone of the normal pattern is restrained.

When the stop switch **24*b* has been operated during generation of this accompaniment tone, the CPU 53 changes the run flag RUN to "0" on the basis of the judgement in step 142 (FIG. 9) and sets the section number SCTN initially to "3" in step 160, executes the lamp routine (FIG. 18) in step 162 and stops forming of an accompaniment tone signal which as been formed in the tone signal forming circuit 40 in step 164. As a result, in the interrupt program (FIG. 20), judgement of NO, i.e., the run flag RUN is not "1", is made in step 442 and execution of the processing of steps 444–456 is stopped and, accordingly, renewal of the time TIME, current timing CTIM, current beat CBET and current bar CBAR is also stopped and, simultaneously, control of generation of the accompaniment tone is stopped. By the initial setting of the section number SCTN to "3" and execution of the lamp routine, the lamp 28*b*** is lighted.

d. Transfer from the Introduction Pattern to the Normal Pattern

Upon turning of of one of the special pattern switches **26*a*–26*c* when the automatic accompaniment is not made (i.e., when the run flag RUN is "0"), the CPU 53 executes "special pattern routine" in step 154 on the basis of judgement of step 142 (FIG. 9). In this special pattern routine, as shown in detail in FIG. 13, execution of the routine is started in step 230 and whether one of the special pattern switches 26*a*–26*c* has been operated or not is judged in step 232**.

When the special pattern switch **26*a* has been operated, by the judgement of step 232, "first special pattern routine" is executed in step 234. This first special pattern routine, as shown in detail in FIG. 14, is started in step 250. In step 252, judgement of NO, i.e., the run flag RUN is not "1", is made and in step 254, the run flag RUN is changed to "1" and the section number SCTN is set to "0". In step 256, "pattern start routine" (FIG. 19) is executed. When the special pattern switch 26*b* has been operated, by the judgement of step 232 (FIG. 13), "second special pattern routine" (FIG. 15) is executed in step 236. By processing of steps 290–296, the run flag RUN is changed to "1", the section number SCTN is set to "1" and the pattern start routine (FIG. 19) is executed. Further, when the special pattern switch 26*c* has been operated, by the judgement of step 232, "third special pattern routine" (FIG. 16) is executed in step 238 and, by processing of steps 330–336, the run flag RUN is changed to "1", the section number SCTN is set to "2" and the pattern start routine (FIG. 19**) is executed.

In this pattern start routine, as described above, the current timing CTIM, current beat CBET, current bar CBAR and the current track bar CRTB(0)–CRTB(8) are respectively set to "0" and "pattern transfer routine" (FIG. 17) is executed. In this pattern transfer routine, in the same manner as described above, one pattern time PTM and pointer for each track are set in accordance with the style number STLN and the section number SCTN, current bar CBAR and current track bar CRTB(0)–CRTB(8) are set to "0" and the section flag SCSW is set to "0".

In this case, since the section number SCTN is set to 0–2, judgement of NO is made in step 382 of FIG. 17 and, by processing of steps 384 and 386, remaining time RTIM representing time from transfer to the special pattern to the end thereof and end time ETIM representing the time point of ending of the special pattern by absolute time are computer by operation of the following formulas (5)

$$RTIM = PTM - CBAR \times BTM - CTIM$$

$$ETIM = TIME + RTIM \qquad (5)$$

In this case, since the current timing CTIM and current bar CBAR are initially set to "0" by the processing of the above described start routine, the remaining time RTIM becomes one pattern time PTM of the introduction pattern (one of INT1–INT3) (section number SCTN=0–2) and the end time ETIM becomes time obtained by adding one pattern time PTM to the current time. In a case where this end time ETIM has reached "5000" or more as a result of the above computation, "5000" is subtracted from the time ETIM by processing of steps 388 and 390.

Then, in step 392 of the pattern transfer routine, the lamp routine (FIG. 18) is executed. Since the section number is set to 0–2, in this lamp routine, the lamp 28*a* representing the introduction pattern only is lighted by processing of steps 402–416.

When the tempo clock signal generator 52 supplies a tempo clock signal to the CPU 53 at each minute time length ΔT in this state, the CPU 53 interrupts, as described above, execution of the main program at each minute time length ΔT and executes the interrupt program of FIG. 20. Since the run flag RUN is set to "1", in this interrupt program, the automatic accompaniment starts and, by the count routine (FIG. 26), the time TIME, current timing CTIM, current beat CBET and current bar CBAR are sequentially renewed and, by processing of the reproduction routine (FIGS. 23 and 24) and the key-off routine (FIG. 25), performance data in the accompaniment data memory 60 is read out and the accompaniment tone of the introduction pattern is sounded. The introduction pattern in this case is one of the introduction patterns INT1–INT3 (SCTN=0–2) corresponding to one of the special pattern switches 26*a*–26*c*.

Since the section number SCTN is set to 0–2 during performance of the introduction pattern (one of INT-1–INT3), in the change with condition routine (FIG. 21) executed in step 444 of the interrupt program (FIG. 20), judgement of NO, i.e., the section number SCTN is not 3≦SCTN≦6 is made in step 462 and whether the time TIME is equal to the set end time ETIM or not is judged in step 480. If one pattern time PTM has not elapsed since start of performance of the introduction pattern, judgement of NO is made in step 480 and the performance of the introduction pattern is continued. If one pattern time PTM has elapsed, "special pattern transfer routine" (FIG. 22) is executed in step 482 on the basis of judgment of YES in step 480.

Execution of this special pattern transfer routine is started in step 490. In step 492, judgement of NO is made on the basis that the section switch flag SCSW is "0". In step 496, on the basis that section number SCTN is 0–2, judgement of YES is made and "3" is added to the section number SCTN in step 498. As a result, when section number SCTN was "0", it is changed to "3". When the section number SCTN was "1", it is changed to "4". When the section number SCTN was "2", it is changed to "5". After processing of step 498, "pattern transfer routine" (FIG. 17) is executed in step 512. In this case, by processing of the count routine (FIG. 26) at a time point when the time TIME coincides with the end time ETIM, the current timing CTIM, current beat CBET and current bar CBAR are initially set to "0", so that pointer for each track indicates each head address of the memory area PLDT(STLN, SCTN,i) designated by the style number STLN and section number SCTN (=3–5) whereby performance of the normal pattern (one of NOR1–NOR3) which has been designated by the section number SCTN (=3–5) is started from the beginning. By execution of the lamp routine (FIG. 18), one of the lamps 28*b*–28*d* corresponding to the section number (=3–5) is lighted.

As described above, when one of the special pattern switches 26*a*–26*c* has been operated when the automatic accompaniment is not made, as shown in FIG. 1, performance of one of the introduction patterns INT1–INT3 (section number SCTN=0–2) corresponding to the operated switch (one of 26*a*–26*c*) is automatically started and the pattern is automatically transferred to one of the normal patterns NOR1–NOR3 (section number SCTN=3–5) at the end of the introduction pattern, As a result, the player has only to select one of the introduction patterns INT1–INT3 for automatically providing an introduction pattern which is suited to the normal pattern (one of NOR1–NOR3).

On the other hand, when one of the normal pattern switches 25*a*–25*d* has been operated during performance of one of the introduction patterns INT1–INT3, as described above, the normal pattern shown in FIG. 12 is executed. In this case, the run flag RUN is set to "1" and the section number SCTN is set to 0–2 and, accordingly, in step 222, next section number SCTN is set to variable i (=3–6) corresponding to the operated normal pattern switch (one of 25*a*–25*d*) and the section flag switch SCSW is set to "1".

Upon completion of performance of one pattern of the introduction pattern, the time TIME becomes equal to the end time ETIM and judgement of YES is made in step 480 of FIG. 21 and the special pattern transfer routine (FIG. 22) is executed. In this case, in the special pattern transfer routine, judgement of YES, i.e., the section switch flag SCSW is "1", is made in step 492. In step 494, the section number SCTN is changed to next section number NSCTN and, in step 512, the pattern transfer routine is executed in step 512. As a result, at a time point when the performance of the introduction pattern (one of INT1–INT3) (section number SCTN=0–2) has ended, the automatic accompaniment is transferred automatically to one of the normal patterns NOR1–NOR4 (section number SCTN=3–6) which as been selected by the player. Thus, when the player has operated one of the normal pattern switches 25*a*–25*d* during performance of the introduction pattern (one of INT1–INT3), the automatic accompaniment is transferred automatically to the selected normal pattern (one of NOR1–NOR4), so that the automatic transfer of the pattern can be changed as desired by the player.

Figure 13:
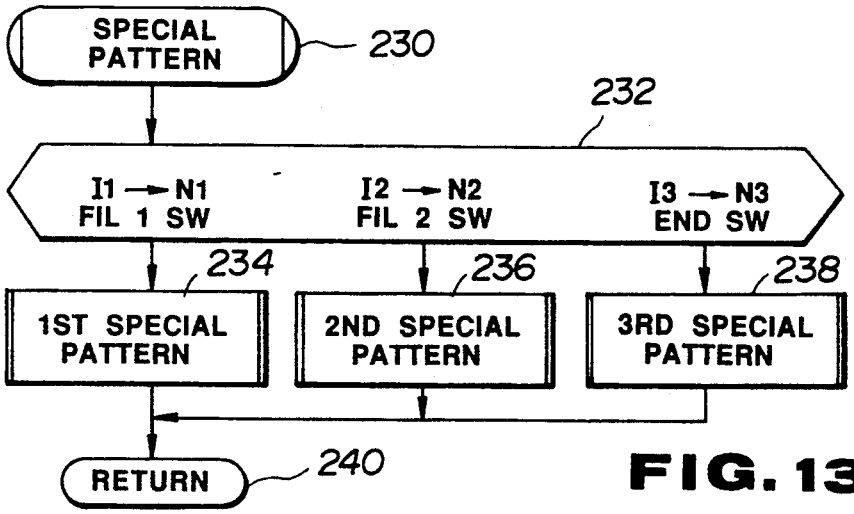
FIG. 13 is a flow chart showing "special pattern routine" of FIG. 9 in detail.
Figure 14:
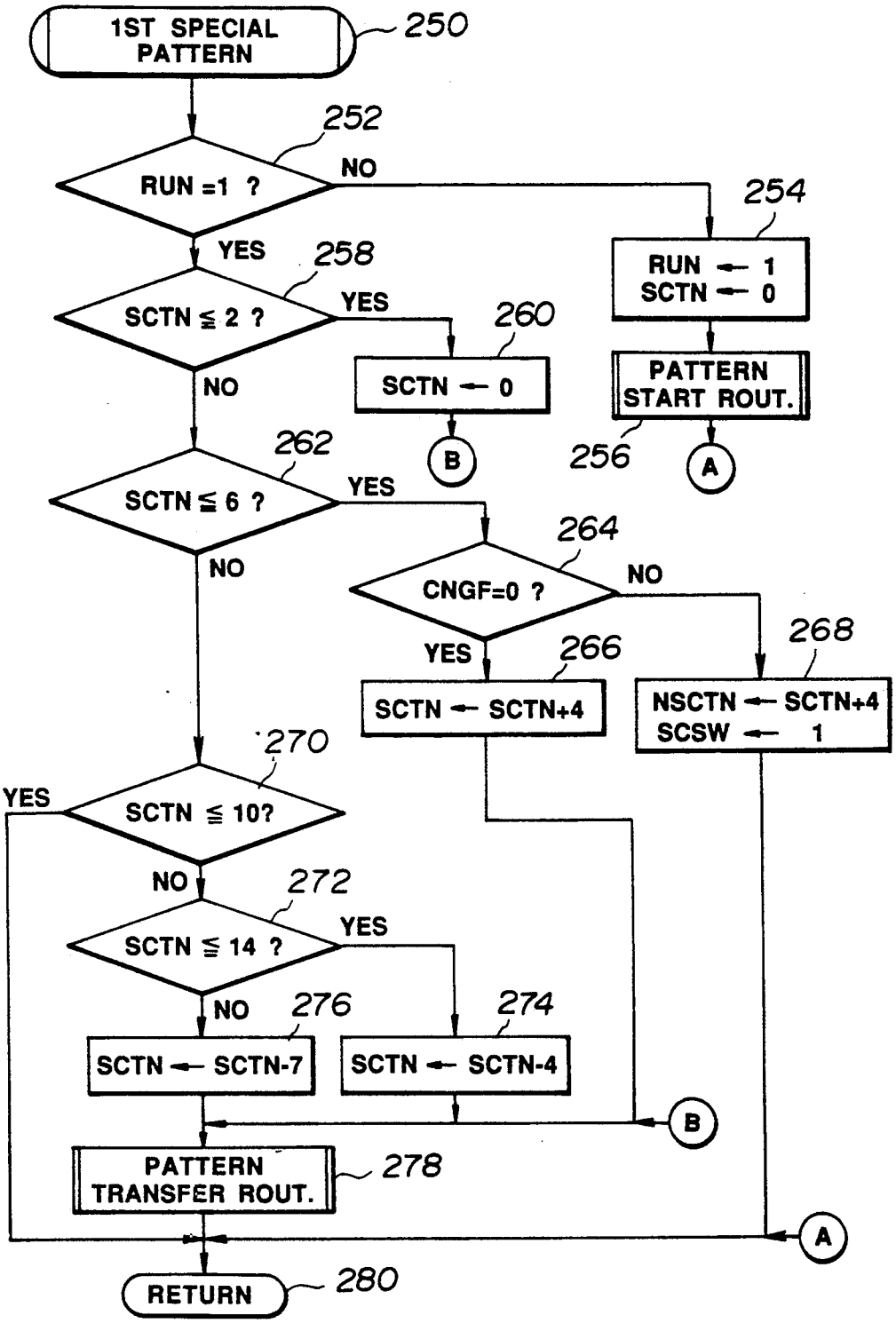
FIG. 14 is a flow chart showing "first special pattern routine" of FIG. 13 in detail.
Figure 15:
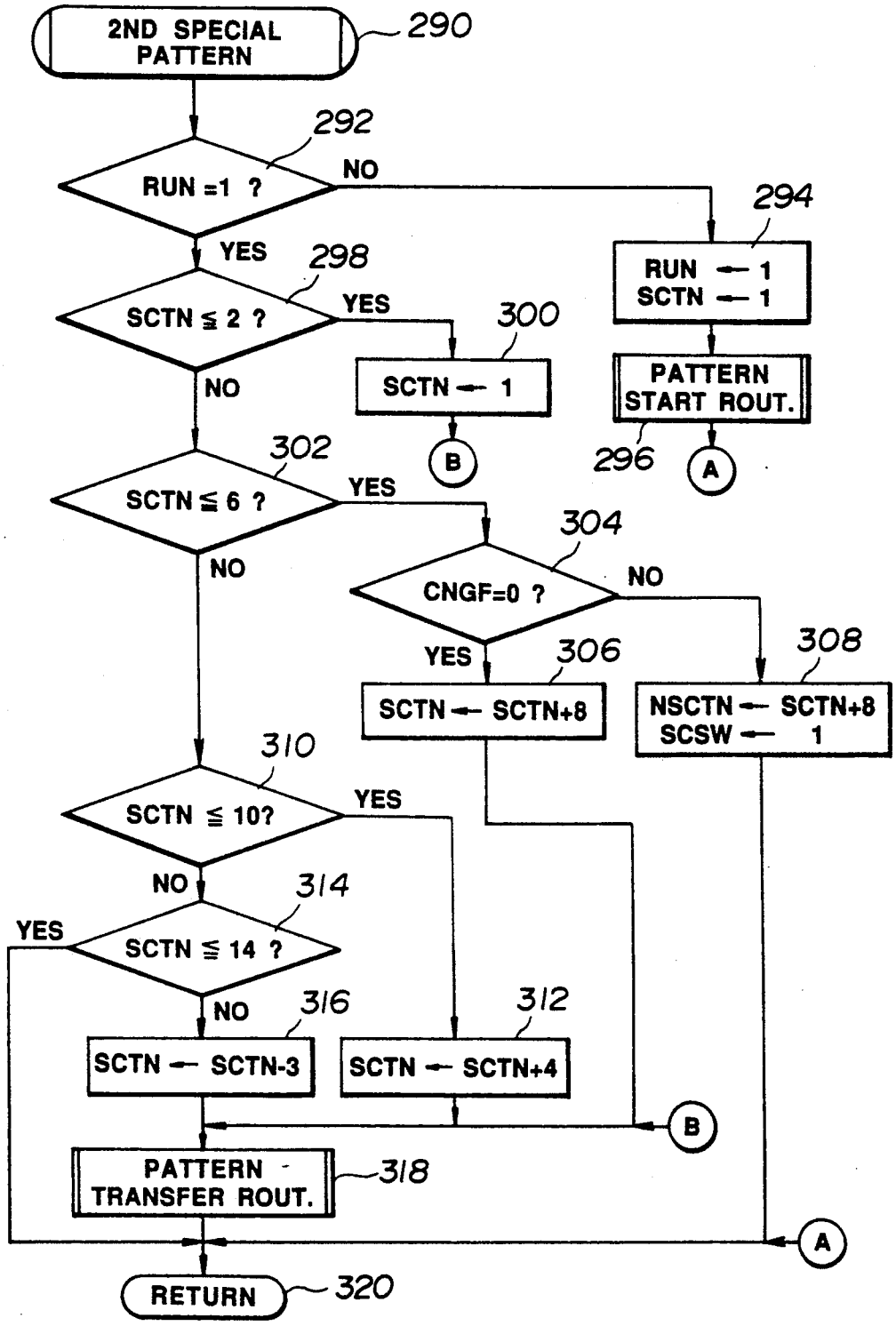
FIG. 15 is a flow chart showing "second special pattern routine" of FIG. 13 in detail.
Figure 16:
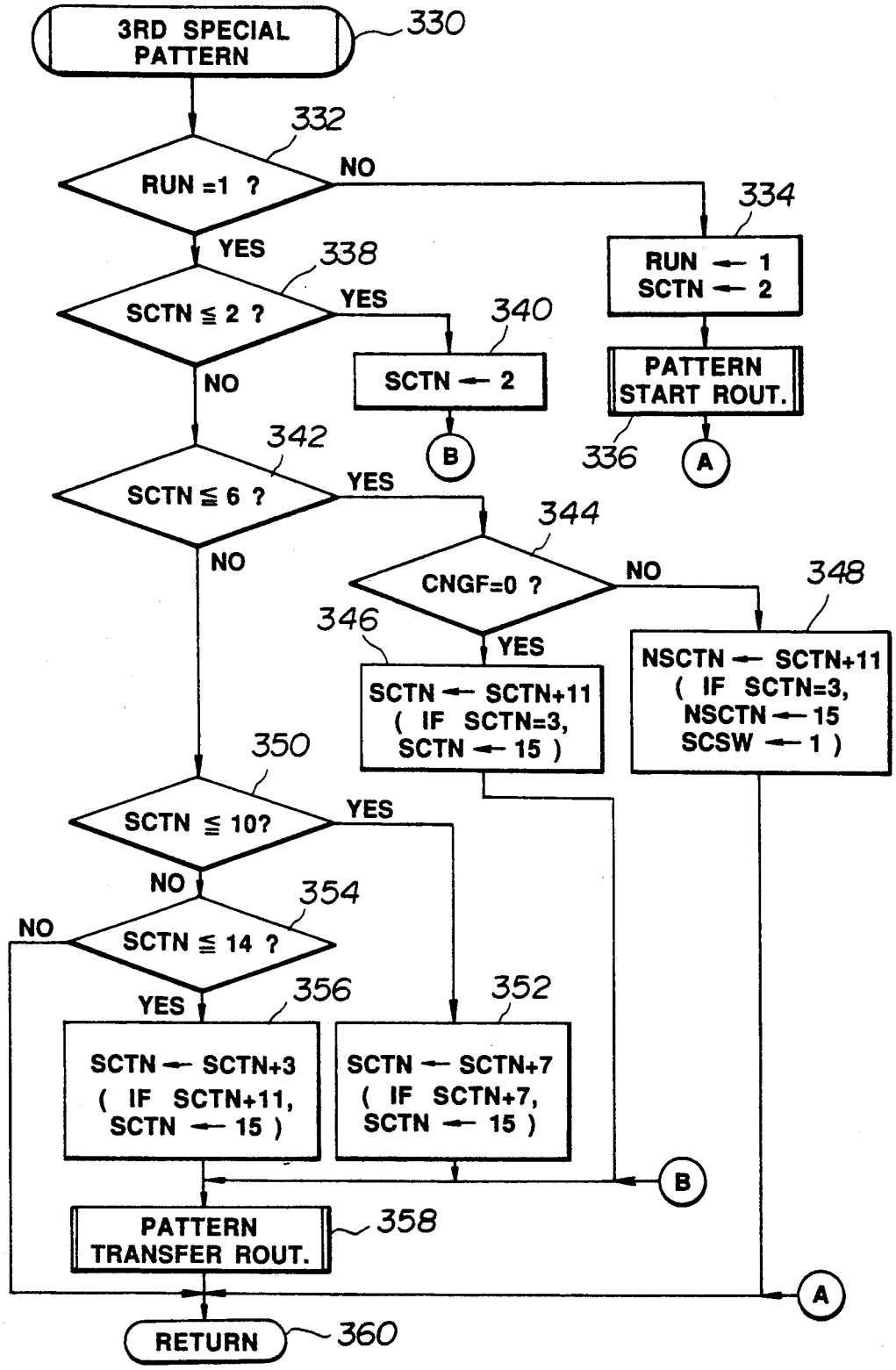
FIG. 16 is a flow chart showing "third special pattern routine" of FIG. 13 in detail.

When one of the special pattern switches 26*a*–26*c* has been operated during performance of one of the introduction patterns INT1–INT3, as described above, the special pattern routine of FIG. 13 is executed and, in accordance with the operated switch (one of 26*a*–26*c*), the first special pattern routine of FIG. 14, the second special pattern routine of FIG. 15 or the third special pattern routine of FIG. 16 is executed. In steps 260, 300 and 340 of these first to third special pattern routines, the section number SCTN is set to 0–2 and the pattern transfer routine is executed in steps 278, 318 and 358 of these routines. By this processing, the previously performed introduction pattern (one of INT1–INT3) is immediately transferred to one of the introduction patterns INT1–INT3 corresponding to the operated special pattern switch (one of 26*a*–26*c*). Further, during transfer of this pattern, by processing of steps 374–378 in the pattern transfer routine (FIG. 17), current bar CBAR, current track bar CTRAB(i)(i=0–8) and pointer for each track are changed to values representing position of progress of the introduction pattern after the transfer and, by processing of steps 384–390, the end time ETIM is also changed to a value representing the end time of the introduction pattern after the transfer. As a result, the introduction pattern (one of INT- 1-INT3) after the transfer is performed from midway and during the remaining time RTIM of the same pattern.

e. Insertion of the Fill-in Pattern

When the special pattern switch 26a has been operated during performance of one of the normal patterns NOR1-NOR4, the CPU 53 executes the special pattern routine (FIG. 13) in step 154 on the basis of the judgement of step 142 (FIG. 9) and executes the first special pattern routine (FIG. 14) of step 234 on the basis of the judgement of step 232 in this special pattern routine. In this case, the run flag RUN is set to "1" and the section number SCTN is set to 3-6, so that steps 252, 258 and 262 are respectively judged to be YES, NO and YES and whether or not the change condition flag CNGF is "0" is judged.

In a case where the change condition flag CNGF is set to "0" by operation of the change condition switch 27 (step 150 of FIG. 9), judgement of YES is made in the above described step 264 and "4" is added to the section number in step 266 and the pattern transfer routine is executed in step 278. The preceding section number SCTN (=3-6) thereby is changed to 7-10 and, as shown in FIG. 1, the preceding normal pattern (one of NOR1-NOR4) is transferred immediately to one of four first fill-in patterns FIL1 designated by the new section number SCTN (=7-10). In this case also, in the same manner as in the above described case, the first fill-in pattern FIL1 after the transfer is performed from midway and during the remaining time RTIM of this pattern FIL1.

In a case where the change condition flag CNGF has been set to "1" during the judgement of step 264 in FIG. 14 (step 150 in FIG. 9), judgement of NO is made in the above step 264 and result of addition of "4" to the section number SCTN in step 268 is set as the next section number NSCTN and the section switch flag SCSW is set to "1". As a result, in this case, at a time point when the special pattern switch 26a has been operated, the performance of the normal pattern (one of NOR-1-NOR4) is not transferred but is continued. When the change with condition routine (FIG. 21) is executed in step 444 of the interrupt program of FIG. 20, judgement of YES is made both in steps 462 and 464 of FIG. 2 and, unless the current timing CTIM becomes a multiple of "24", i.e., timing representing the head of the beat, the performance of the normal pattern is continued on the basis of the judgement NO in step 468. When the current timing CTIM has become a multiple of "24", i.e., the timing representing the head of the beat, judgement of YES is made in step 468 and the program proceeds to step 470 and subsequent steps.

In step 470, the change condition STLTBL(STLN).SCC which has been stored in the style table STLTBL and designated by the style number STLN is read out and whether or not the condition STLTBL(STLN).SCC is "0" is judged. This change condition STLTBL(STLN).SCC represents that transfer of the pattern is allowed at an odd beat (first beat or third beat) when it is "0" and that transfer of the pattern is allowed only at the first beat when it is "1". When the condition STLTBL(STLN).SCC is "0", therefore, whether or not the value remaining after dividing the current beat by "2" is "0", i.e., whether or not the performance of the normal pattern (one of NOR1-NOR4) is the first beat or third beat is judged in step 472. When the condition STLTBL(STLN).SCC is "1", whether or not the current timing CTIM is "0", i.e., whether or not the performance of the normal pattern is the first beat is judged in step 474. When the result of the judgment is either that the change condition STLTBL(STLN).SCC is "0" and the remaining value after dividing the current beat CBET by "2" is "0" or that the change condition STLTBL(STLN).SCC is "1" and the current timing CTIM is "0", the next section number NSCTN is set as the section number SCTN in step 478. Otherwise, the processing of steps 476 an 478 is not executed but the change with condition routine is ended in step 484. As a result, when the change condition flag CNGF is set to "1", at a time point when the performance of the current normal pattern (one of NOR1-NOR4) has become the odd beat or the first beat in accordance with the change condition STLTBL(STLN).SCC for each accompaniment style, the automatic accompaniment is transferred automatically from the normal pattern (one of NOR1-NOR4) to the first fill-in pattern FIL1. In this case also, in the same manner as in the above described case, the first fill-in pattern after the transfer is performed during the remaining time RTIM.

As the first fill-in pattern is performed during the remaining time RTIM both when the change condition flag CNGF is "0" and when it is "1", the time TIME becomes equal to the end time ETIM and, on the basis of judgement of YES in step 480, the special pattern transfer routine (FIG. 22) is executed in step 482. In this case, in the special pattern transfer routine (FIG. 22), judgements of NO, NO and YES are made in steps 492, 496 and 500. In step 502, "4" is subtracted from the section number SCTN and in step 512, processing of the pattern transfer routine is executed. The previous section number SCTN (=7-10) is thereby restored to 3-6 again and, as shown in FIG. 1, the previous normal pattern (one of NOR1-NOR4) is performed again.

In this manner, by operating the special pattern switch 26a during performance of the normal pattern (one of NOR1-NOR4) (section number SCTN=3-6), performance of one of the four first fill-in patterns FIL1 suited to the previous normal pattern is automatically inserted and, accordingly, performance of a fill-in pattern suited to the music can be enjoyed in a simple manner. Further, by operating the change condition switch 27 in this case, the transfer from the normal pattern (one of NOR1-NOR4) to one of the four first fill-in patterns FIL1 can be selected between transfer with condition (i.e., next odd beat or first beat) and immediate transfer and, accordingly, the will of the player can be reflected on the fill-in performance.

When the special pattern switch 26b has been operated during performance of one of the normal patterns NOR1-NOR4, the CPU 53 executes, in the same manner as described above, the special pattern routine shown in FIG. 13. In this special pattern routine, on the basis of the judgement in step 232, "second special pattern routine" (FIG. 15) is executed in step 236. In this case also, the run flag RUN is set to "1" and the section number SCTN is set to 3-6 and, therefore, judgements of YES, NO and YES are made in steps 292, 298 and 302 and whether or not the change condition flag CNGF is "0" is judged in step 304.

In the same manner as in the above described first special pattern routine, the case where the change condition flag CNGF if set to "0" will first be described. In step 304, judgement of YES is made and, in step 306, "8" is added to the section number SCTN and, in step 318, processing of the pattern transfer routine is executed. The previous section number SCTN (=3-6) is thereby changed to 11-14 and, as shown in FIG. 1, the previous normal pattern (one of NOR1-NOR4) is immediately transferred to one of four second fill-in patterns FIL2 designated by the new section number SCTN (=11-14).

Nextly, the case where the change condition flag CNGF is set to "1" will be described. In step 304, judgement is NO is made. In step 308, result of adding "8" to the section number SCTN is set as the next section number NSCTN and the section switch flag SCSW is set to "1". As a result, in this case, at a time point when the special pattern switch **26*b*** has been operated, the performance of the normal pattern (one of NOR-1-NOR4) is continued without being transferred and, at a time point of arrival of the condition determined by the change condition STLTBL(STLN).SCC, the normal pattern (one of NOR1-NOR4) is transferred to one of the second fill-in patterns FIL2. In this case also, in the same manner as in the above described case, the second fill-in pattern FIL2 after the transfer is performed during the remaining time RTIM.

As described above, both when the change condition flag CNGF is "0" and when it is "1", the time TIME becomes equal to the end time ETIM when the performance of the second fill-in pattern during the remaining time RTIM is completed and, on the basis of judgement of YES in step 480 of FIG. 21, the special pattern transfer routine (FIG. 22) is executed in step 482. In this case, in the special pattern transfer routine, judgements of NO, NO, NO and YES are made in steps 492, 496, 500 and 504 and whether or not the section number SCTN is "12" or below is judged. When the section number SCTN is 12 or below, judgement of YES is made in step 506 and "6" is subtracted from the section number SCTN in step 508 and the pattern transfer routine is executed in step 512. When the section number SCTN is "13" or more, judgement of NO is made in step 506 and "10" is subtracted from the section number SCTN in step 510 and the pattern transfer routine is executed in step 512. Accordingly, as shown in FIG. 1, when the second fill-in pattern FIL2 of the section number SCTN=11 or 12 is performed, the accompaniment pattern is transferred to the normal pattern NOR3 or NOR4 of the section number SCTN=5 or 6 whereas when the second fill-in pattern FIL2 of the section number SCTN=13 or 14 is performed, the accompaniment pattern is transferred to the normal pattern NOR1 or NOR2 of the section number SCTN=3 or 4.

In the foregoing manner, by operating the special pattern switch **26*a* during performance of the normal pattern NOR1 or NOR2 (section number SCTN=3 or 4), the second fill-in pattern FIL2 of the section number SCTN=11 or 12 suited to the previous normal pattern NOR1 or NOR2 is performed and, thereafter, the automatic accompaniment is transferred automatically to the normal pattern NOR3 or NOR4 (section number SCTN=5 or 6). As a result, the pattern of the automatic accompaniment can be changed automatically in accordance with the flow of music and an automatic accompaniment which is rich in variety can be enjoyed by a simple operation. In this case also, the transfer from one of the normal patterns NOR1-NOR4 to one of the four second fill-in patterns FIL2 can be selected by operation of the change condition switch 27** between the transfer with condition (next odd beat or first beat) and the immediate transfer, so that the will of the player can be reflected on the fill-in performance.

Figure 12:
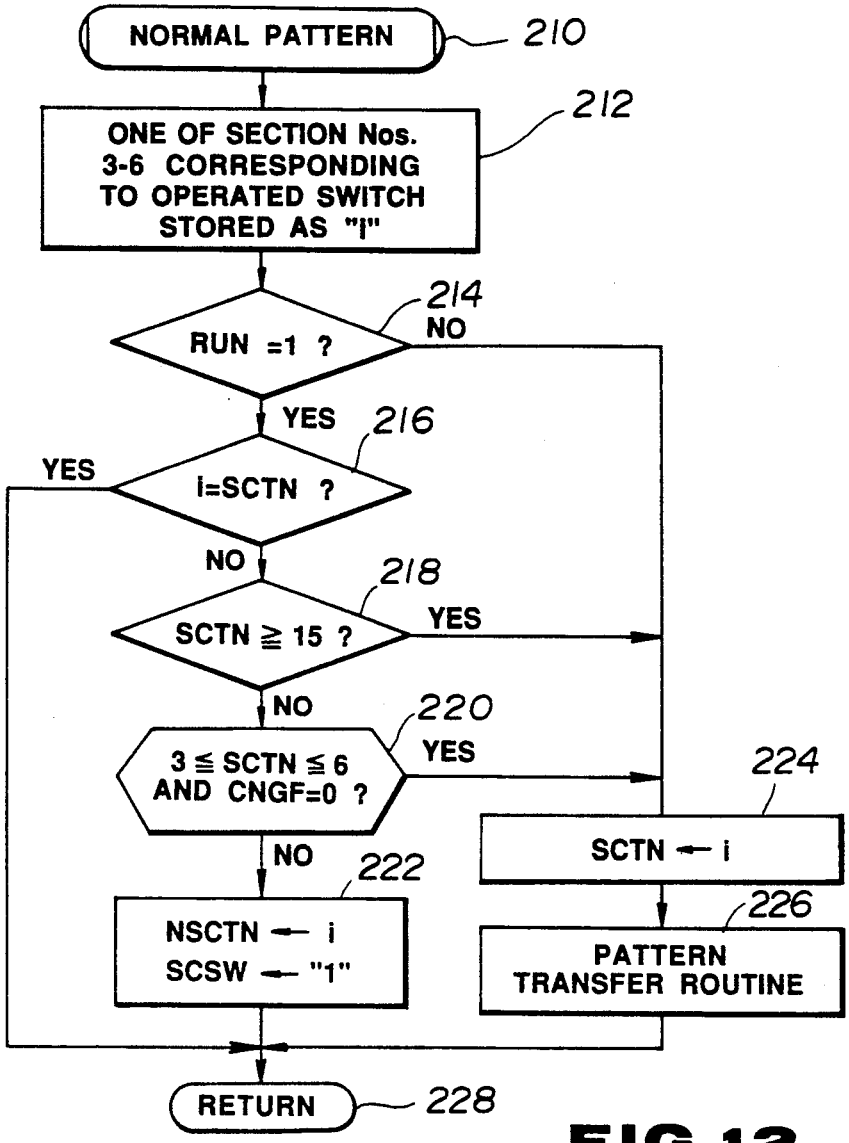
FIG. 12 is a flow chart showing "normal pattern routine" of FIG. 9 in detail.

When one of the normal pattern switches **25*a*-25*d* has been operated during performance of one of the first fill-in patterns FIL1 (section number SCTN=7-10) or one of the second fill-in patterns FIL2 (section number SCTN=11-14), the CPU 53 executes, in the same manner as in the above described case, the normal pattern routine of FIG. 12. In this normal pattern routine, in step 212, the variable i is set to a value (3-6) corresponding to one of the normal pattern switches 25*a*-25*d* and, thereafter, on the basis of the run flag RUN which is set to "1" and the section number SCTN which is set to 7-14, judgements of YES, NO, NO and NO are made in steps 214, 316, 218 and 220. In step 222, the variable i is set as the next section number NSCTN and the section switch flag SCSW is set to "1". By this processing, in this case, at a time point when one of the normal pattern switches 25*a*-25*d* has been operated, the pattern which is currently being performed is not transferred but, at a time point when the first or second fill-in pattern FIL1 or FIL2 has ended, the pattern is transferred to one of the normal patterns NOR1-NOR4 (section number SCTN=3-6) corresponding to the previously operated normal pattern switch (one of 25*a*-25*d*) by processing of steps 462, 480 and 482 of FIG. 21 and processing of steps 492 and 494 of FIG. 22**. As a result, as described above, the automatic pattern is not transferred from the first or second fill-in pattern FIL1 or FIL2 to a predetermined normal pattern (one of NOR1-NOR4) but the player can designate a normal pattern (one of NOR-1-NOR4) to which the pattern should be transferred.

When one of the normal pattern switches **25*a*-25*d* has been operated during performance of one of the normal patterns NOR1-NOR4 (section number SCTN=3-6), the CPU 53 executes, in the same manner as in the above described case, the normal pattern routine of FIG. 12. In this normal pattern routine, in step 212, the variable i is set to a value (3-6) corresponding to the operated normal pattern switch (one of 25*a*-25*d*) and, on the basis of judgement of YES in step 214, i.e., the run flag RUN is "1", the program of step 216 and subsequent steps is executed. In this case, when the operated normal pattern switch (one of 25*a*-25*d*) is the same as the normal pattern (one of NOR1-NOR4) which is currently being performed and the variable i is equal to the section number SCTN, judgement of YES is made in step 216 and transfer of the pattern is not made. When the operated normal pattern switch (one of 25*a*-25*d*) is different from the normal pattern which is currently being performed, on the basis of judgement of NO in both steps of 216 and 218, judgement of YES is made in step 220 only when the normal pattern (one of NOR-1-NOR4) is being performed and the change condition flag CNGF is "0". In this case, in step 224, the section number SCTN is changed to the variable i and, in step 226, the pattern transfer routine is executed whereby the automatic accompaniment pattern is transferred immediately to one of the normal pattern NOR1-NOR4 (section number SCTN=3-6) corresponding to the operated normal pattern switch (one of 25*a*-25*d*). Otherwise, i.e., when the normal pattern (one of NOR-1-NOR4) (section number SCTN=3-6) is being performed but the change condition flag CNGF is "1", judgement of NO is made in step 220. Since, in this case, the variable i is set to the next section number NSCTN and the section switch flag SCSW is set to "1", the pattern which is currently being performed is not transferred at a time point when the normal pattern switch (one of 25*a*-25*d*) has been operated but the normal pattern (one of NOR1–NOR4) (section number SCTN=3–6) which is currently being performed is transferred to the normal pattern (one of NOR-1–NOR4) (section number SCTN=3–6) corresponding to the operated normal pattern switch (one of 25***a*–25*d*) in accordance with the change condition STLTBL(STLN).SCC (odd beat or first beat).

When one of the special pattern switches 26*a* and 26*b* has been operated during performance of the first or second fill-in patterns FIL1 or FIL2 (section number SCTN =7–8, 11–14), the CPU 53 executes, in the same manner as in the above described case, the special pattern routine of FIG. 13. In this special pattern routine, when the special pattern switch 26*a* has been operated, the first special pattern routine of FIG. 14 is executed. When the pattern which is currently being performed is the first fill-in pattern FIL1, on the basis of judgement of YES in step 270, transfer of the pattern is not made. When the pattern which is currently being performed is the second fill-in pattern FIL2, on the basis of judgements of NO and YES in steps 270 and 272, "4" is subtracted from the section number SCTN in step 274 and the pattern transfer routine is executed in step 278 whereby the first fill-in pattern FIL1 is transferred immediately to the second fill-in pattern FIL2. When the special pattern switch 26*b* has been operated, the second special pattern routine of FIG. 15 is executed. When the pattern which is currently being performed is the second fill-in pattern FIL2, on the basis of judgement of YES in step 314, transfer of the pattern is not made. When the pattern which is currently being performed is the first fill-in pattern FIL1, on the basis of judgement of YES in step 310, "4" is added to the section number SCTN in step 312 and the pattern transfer routine is executed in step 318 whereby the second fill-in pattern FIL2 is transferred immediately to the first fill-in pattern FIL1.

f. Addition of the Ending Pattern

When the special pattern switch 26*c* has been operated during performance of one of the normal patterns NOR1–NOR4, on the basis of the judgement of step 142 (FIG. 9), the special pattern routine (FIG. 13) is executed in step 154. On the basis of the judgement of step 232 of this special pattern routine, the third special pattern routine (FIG. 16) of step 238 is executed. In this case, the run flag RUN is set to "1" and the section number is set to 3–6 and, accordingly, judgements of YES, NO and YES are made in steps 332, 338 and 342 and whether or not the change condition flag CNGF is "0" is judged in step 344.

When the change condition flag CNGF is set to "0" by operation of the change condition switch 27 (step 150 in FIG. 9), judgement of YES is made in step 344. In step 346, "11" is added to the section number SCTN (though the section number SCTN is set to "15" when the section number SCTN is "3") and the pattern transfer routine is executed in step 358. The previous section number SCTN (=3–6) is changed to 15–17 and, as shown in FIG. 1, the previous normal pattern (one of NOR1–NOR4) is transferred immediately to one of the ending patterns END1–END3 designated by the new section number SCTN (=15–17) and the lamp 28*f* only is lighted. In this case also, the ending pattern (one of END1–END3) after the transfer is performed from midway and during the remaining time RTIM.

On the other hand, when the change condition flag has been set to "1" (step 150 of FIG. 9) at the time of judgement in step 344 in FIG. 16, judgement of NO is made in this step 344. In step 348, result of adding "11" to the section number SCTN is set as the next section number NSCTN (when the section number is "3", the next section number NSCTN is set to "15") and the section switch flag SCSW is set to "1". As a result, in this case, the normal pattern (one of NOR1–NOR4) is continued without being transferred at a time point when the special pattern switch 26*c* has been operated. When the change with condition routine is executed in step 444 of the interrupt program of FIG. 20, judgement of YES is made in both steps 462 and 464 of FIG. 21 and, at a time point when the condition determined by the change condition STLBTL(STLN).SCC (odd beat or first beat) has been satisfied by processing of steps 468–478, the normal pattern (one of NOR1–NOR4) is transferred automatically to one of the ending patterns END1–END3. In this case also, the ending pattern (one of END1–END3) after the transfer is performed during the remaining time RTIM.

Both when the change condition flag CNGF is "0" and when it is "1", upon completion of performance of the ending pattern (one of END1–END3) for the remaining time RTIM, the time TIME becomes equal to the end time ETIM and, on the basis of judgement of YES in step 480 of FIG. 21, the special pattern transfer routine (FIG. 22) is executed in step 482. In this special transfer routine, since the section switch flag SCSW is "0" and the section number SCTN is 15–17, judgement in steps 492, 496, 500 and 504 is all NO. In steps 514–518, in the same manner as in the case where the stop switch 24*b* has been operated (steps 160–164 in FIG. 9), the run flag RUN is changed to "0", the section number SCTN is set initially to "3" and the lamp routine is executed. In step 518, a sound stopping processing is executed and the operation of the automatic accompaniment is stopped.

In the above described manner, by operating the special pattern switch 26*c* during performance of the normal pattern (one of NOR1–NOR4), one of the ending patterns END1–END3 suited to the normal pattern is performed and thereafter the automatic accompaniment is stopped. As a result, an ending pattern (one of END1–END3) which is suited to the normal pattern (one of NOR1–NOR4) can be automatically added. In this case also, transfer from the normal pattern (one of NOR1–NOR4) to the ending pattern (one of END1–END3) can be selected by operation of the change condition switch 27 between the transfer with condition (at next odd beat or first beat) and the immediate transfer and, accordingly, the will of the player can be reflected on the ending pattern.

When the special pattern switch 26*c* has been operated during performance of the first or second fill-in pattern FIL1 or FIL2 (section number SCTN=7–14), the CPU 53 executes, as described before, the special pattern routine of FIG. 16. In steps 350–356, when the previous section number SCTN is 7–10, "7" is added to the section number SCTN to set the section number SCTN to 15–17 (when the section number SCTN is 7, the section number is set to 15) and, when the previous section number SCTN is 11–14, "3" is added to the section number to set it to 15–17 (when the previous section number SCTN is 11, the section number is set to 15). In step 358, the pattern transfer routine is executed. By this processing, the first or second fill-in pattern FIL1 or FIL2 is transferred immediately to one of the ending patterns END1–END3.

When one of the normal pattern switches 25a–25d has been operated during performance of one of the ending patterns END1–END3, the ending pattern (one of END1–END3) is transferred immediately to one of the normal patterns NOR1–NOR4 corresponding to the operated normal pattern switch (one of 25a–25d) by processing of steps 218, 224 and 226 of FIG. 12. Further, when one of the special pattern switches 26a or 26b has been operated during performance of one of the ending patterns END1–END3, the ending pattern is transferred immediately to one of the first fill-in patterns FIL1 (section number SCTN=8–10) or the second fill-in patterns FIL2 (section number SCTN=12–14) by processing of steps 272, 276 and 278 of FIG. 14 or steps 314, 316 and 318 of FIG. 15.

In the above described embodiment, predetermined performance data is stored in the accompaniment data memory 60. Alternatively, this memory 60 may be constructed of a RAM so that the player can write desired data therein or desired data can be written from exterior recording media such as magnetic tapes and magnetic disks.

What is claimed is:

1. An automatic accompaniment device comprising:

data memory means storing plural introduction pattern data and plural normal pattern data for each of plural accompaniment styles, each of said plural introduction pattern data corresponding to specific one of said plural normal pattern data;

accompaniment style designation means for designating one of said plural accompaniment styles;

introduction pattern designation means for designating one of said plural introduction pattern data;

introduction readout control means for reading from said data memory means the introduction pattern data designated by said introduction pattern designation means among the plural introduction pattern data of the accompaniment style designated by said accompaniment style designation means;

normal readout control means for reading, after reading of the introduction pattern data by said introduction readout control means, the normal pattern data corresponding to the read out introduction pattern data from said data memory means; and accompaniment tone signal generation means for generating an accompaniment tone signal in accordance with the introduction pattern data and normal pattern data read out by said readout control means.

2. An automatic accompaniment device as defined in claim 1 further comprising:

normal pattern designation means for designating one of said plural normal pattern data; and change means, responsive to designation of the normal pattern data by said normal pattern designation means during reading of the introduction pattern data by said introduction readout control means, for changing normal pattern data which is to be read from said data memory means by said normal readout control means to the normal pattern data which has been designated by said normal pattern designation means.

3. An automatic accompaniment device as defined in claim 1 wherein said introduction pattern designation means comprises switch means for selecting a desired one from among said plural introduction pattern data.

4. An automatic accompaniment device comprising:

data memory means storing plural normal pattern data and plural fill-in pattern data for each of plural accompaniment styles, each of said plural normal pattern data corresponding to specific one of said plural fill-in pattern data;

accompaniment style designation means for designating one of said plural accompaniment styles;

normal pattern designation means for designating one of said plural normal pattern data;

fill-in instruction means for instructing execution of a fill-in performance;

normal readout control means for reading from said data memory means the normal pattern data designated by said normal pattern designation means among the plural normal pattern data of the accompaniment style designated by said accompaniment style designation means;

fill-in readout control means, responsive to instruction of the fill-in performance by said fill-in designation means during reading of the normal pattern data by said normal readout control means, for reading the fill-in pattern data corresponding to the normal pattern data which has been read out by said normal readout control means from said data memory means instead of reading of the normal pattern data;

normal pattern restoration means for redesignating, upon completion of reading of the fill-in pattern data by said fill-in readout control means, the normal pattern data which was previously read out and controlling said normal readout control means to read out the redesignated normal pattern data from said data memory means; and accompaniment tone signal generation means for generating an accompaniment tone signal in accordance with the normal pattern data and fill-in pattern data which have been read by said readout control means.

5. An automatic accompaniment device as defined in claim 4 which further comprises designation change means, responsive to designation of the normal pattern data by said normal pattern designation means during reading of the fill-in pattern data by said fill-in readout control means, for controlling said normal pattern restoration means to designate the normal pattern data which has been designated by said normal pattern designation means instead of the normal pattern data which was previously read out.

6. An automatic accompaniment device as defined in claim 5 wherein said normal pattern designation means comprises switch means for selecting a desired one from among said plural normal pattern data.

7. An automatic accompaniment device comprising:

data memory means storing plural normal pattern data and plural fill-in pattern data for each of plural accompaniment styles, each of said plural normal pattern data corresponding to specific one of said plural fill-in pattern data;

accompaniment style designation means for designating one of said plural accompaniment styles;

normal pattern designation means for designating one of said plural normal pattern data;

fill-in instruction means for instructing execution of a fill-in performance;

normal readout control means for reading from said data memory means the normal pattern data designated by said normal pattern designation means among the plural normal pattern data of the accompaniment style designated by said accompaniment style designation means;

fill-in readout control means, responsive to instruction of the fill-in performance by said fill-in instruction means during reading of the normal pattern data by said normal readout control means, for reading the fill-in pattern data corresponding to the normal pattern data which as been read out by said normal readout control means from said data memory means instead of reading of the normal pattern data;

normal pattern restoration means for designating, upon completion of reading of the fill-in pattern data by said fill-in readout control means, second normal pattern data which is different from the normal pattern data which was previously read out and controlling said normal readout control means to read out the designated second normal pattern data from said data memory means; and accompaniment tone signal generation means for generating an accompaniment tone signal in accordance with the normal pattern data and fill-in pattern data which have been read by said readout control means.

8. An automatic accompaniment device comprising:

data memory means storing plural normal pattern data and plural fill-in pattern data for each of plural accompaniment styles, first one of said plural normal pattern data corresponding to first one of said plural fill-in pattern data, second one of said plural normal pattern data corresponding to second one of said plural fill-in pattern data;

accompaniment style designation means for designating one of said plural accompaniment styles;

normal pattern designation means for designating one of said plural normal pattern data;

fill-in instruction means having a switch for instruction execution of a fill-in performance;

normal readout control means for reading from said data memory means the normal pattern data designated by said normal pattern designation means among the plural normal pattern data of the accompaniment style designated by said accompaniment style designation means;

fill-in readout control means for reading, in response to instruction of the fill-in performance by said fill-in designation means during reading of the first normal pattern data by said normal readout control means, the first fill-in pattern data from said data memory means instead of reading of the first normal pattern data by said normal readout control means and, also for reading, in response to instruction of the fill-in performance by said fill-in instruction means during reading of the second normal pattern data by said normal readout control means, the second fill-in pattern data from said data memory means instead of reading the second normal pattern data by said normal readout control means;

normal pattern restoration means for designating, upon completion of reading of the fill-in pattern data by said fill-in readout control means, the second normal pattern data if the fill-in pattern data which has been read out is the first fill-in pattern data and controlling said normal readout control means to read out the designated second normal pattern data from said data memory means and designating the first normal pattern data if the fill-in pattern data which has been read out is the second fill-in pattern data and controlling said normal readout control means to read out the designated first normal pattern data from said data memory means; and accompaniment tone signal generation means for generating an accompaniment tone signal in accordance with the normal pattern data and fill-in pattern data which have been read by said readout control means.

9. An automatic accompaniment device comprising:

data memory means storing plural normal pattern data and plural ending pattern data for each of plural accompaniment styles, each of said plural normal pattern data corresponding to specific one of said plural ending pattern data;

accompaniment style designation means for designating one of said plural accompaniment styles;

normal pattern designation means for designating one of said plural normal pattern data;

ending instruction means for instructing execution of and ending performance;

normal readout control means for reading from said data memory means the normal pattern data designated by said normal pattern designation means among the plural normal pattern data of the accompaniment style designated by said accompaniment style designation means;

ending readout control means, responsive to instruction of the ending performance by said ending instruction means during reading of the normal pattern data by said normal readout control means, for stopping reading of the normal pattern data by said normal readout control means and, for reading from said data memory means the ending pattern data corresponding to the normal pattern data which as been read out; and accompaniment tone signal generation means for generating an accompaniment tone signal in accordance with the normal pattern data and ending pattern data which ave been read by said readout control means.

* * * * *